US009266335B2

(12) United States Patent
Miyazawa

(10) Patent No.: US 9,266,335 B2
(45) Date of Patent: Feb. 23, 2016

(54) WIPER DEVICE AND FLUID EJECTION DEVICE

(71) Applicant: SEIKO EPSON CORPORATION, Tokyo (JP)

(72) Inventor: Hisashi Miyazawa, Okaya (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/642,456

(22) Filed: Mar. 9, 2015

(65) Prior Publication Data

US 2015/0251432 A1 Sep. 10, 2015

(30) Foreign Application Priority Data

Mar. 10, 2014 (JP) ..... 2014-045990

(51) Int. Cl.
*B41J 2/165* (2006.01)
*B08B 1/00* (2006.01)

(52) U.S. Cl.
CPC ..... *B41J 2/16538* (2013.01); *B08B 1/006* (2013.01); *B08B 1/007* (2013.01)

(58) Field of Classification Search
CPC ..... B41J 2/16552; B41J 2/16538; B41J 2/16505; B41J 2/1707; B41J 2/1714
USPC ..... 347/33
See application file for complete search history.

(56) References Cited

U.S. PATENT DOCUMENTS

| | | | | |
|---|---|---|---|---|
| 6,151,044 | A * | 11/2000 | Gaasch | 347/33 |
| 2005/0225593 | A1* | 10/2005 | Ito et al. | 347/33 |
| 2009/0051728 | A1* | 2/2009 | Miyazawa | 347/30 |
| 2011/0090282 | A1* | 4/2011 | Miyazawa | 347/33 |
| 2013/0300800 | A1* | 11/2013 | Ahl et al. | 347/33 |

FOREIGN PATENT DOCUMENTS

| | | | |
|---|---|---|---|
| JP | 2001-30507 | A | 2/2001 |
| JP | 2011-104979 | A | 6/2011 |

* cited by examiner

*Primary Examiner* — Shelby Fidler
*Assistant Examiner* — Tracey McMillion
(74) *Attorney, Agent, or Firm* — Hauptman Ham, LLP

(57) ABSTRACT

A wiper device of a printer has four wiper units arranged in a line to wipe the nozzle faces of an inkjet head. Each wiper unit has a first intermittent gear and a second intermittent gear which sequentially mesh with first and second drive gears and sequentially transverse axis X a wiping operation and a cleaning operation. The wipers move vertically to the nozzle faces. A wiper cleaner lever-rocks between a closed position covering the wiper and an open position not touching the wiper, moves through a path not interfering with the wiper in an opening operation, and through a path wiping the wiper and removing ink and other accretions from the wiper in a closing operation.

9 Claims, 14 Drawing Sheets

WIPER DEVICE AND FLUID EJECTION DEVICE

RELATED APPLICATIONS

The instant application claims the benefit of Japanese patent application No. 2014-045990 filed Mar. 10, 2014, the entire disclosures of which are incorporated by reference herein.

BACKGROUND

1. Technical Field

The present disclosure relates to technology for wiping ink or other fluid accretions from the nozzle face of a fluid ejection head.

2. Related Art

Inkjet printers are one type of fluid ejection device having a fluid ejection head for ejecting ink or other fluid. Ink and foreign matter such as paper dust may accrete on the nozzle face of the inkjet head (fluid ejection head) in an inkjet printer. One method of the related art used to prevent problems caused by such accretions is to wipe the nozzle face with the edge of a wiper blade made from rubber or other elastic material and remove the accretions.

JP-A-2001-30507 describes a device having a wiper for each nozzle head in an inkjet printer having four nozzle heads that eject different colors of ink. Each wiper is mounted on a wiper carrier, and a wiper moving means is provided for each wiper carrier. Each wiper moving means can be driven independently. The nozzle heads that need wiping can therefore be wiped selectively.

JP-A-2011-104979 describes an inkjet printer having a wiper unit. In addition to a wiper, the wiper unit described in JP-A-2011-104979 has a wiper cleaner for cleaning the wiper. The wiper unit has a maintenance unit motor as a drive source, and moves the wiper and wiper cleaner in conjunction with each other by means of a cam mechanism. More specifically, the wiper is cleaned once before wiping the nozzle face because the wiper rises while sliding in contact with the wiper cleaner. Furthermore, because the wiper cleaner moves vertically after the wiping operation, the wiper is cleaned twice.

JP-A-2011-104979 teaches a wiper unit having a wiper cleaner for removing ink and other accretions from the wiper, and uses a single motor to move the wiper cleaner and the wiper. However, because both the wiper and the wiper cleaner move vertically, the wiper cleaner may not be able to reliably remove ink and other accretions from the wiper. JP-A-2011-104979 is also silent about processing the ink and other accretions transferred to the wiper cleaner, and the wiping ability of the wiper cleaner and wiper may be impaired. The ink and other accretions transferred to the wiper cleaner may also be transferred back to the wiper.

To selectively wipe the plural head units (nozzle heads), the wiper unit disclosed in JP-A-2001-30507 drives each wiper with an individual moving means to wipe. However, a configuration having an actuator for each wiper has many parts, is structurally complex, and is difficult to reduce in size. Furthermore, to move a wiper cleaner in addition to the wiper as described in JP-A-2011-104979, the construction becomes even more complex and achieving a compact configuration is even more difficult.

SUMMARY

An objective of the present invention is to provide a wiper device that can perform a wiping operation with a wiper and a cleaning operation with a wiper cleaner, can be compactly constructed, and has excellent performance removing ink and other accretions.

A wiper device according to the invention has a drive shaft that turns based on rotation of a motor; and a plurality of wiper units disposed in a line along the drive shaft to wipe based on rotation of the drive shaft in one direction. Each wiper unit has a wiper configured to perform a wiping operation moving between a retracted position where the wiper does not contact the nozzle face of a fluid ejection head, and a wiping position where the wiper can wipe the nozzle face of the fluid ejection head, and a wiper cleaner configured to perform a cleaning operation sliding against the wiper in a direction crosswise to the direction of wiper movement.

The wiper device of the invention thus comprised has plural wiper units each including a wiper and a wiper cleaner, and sequentially operate both the wipers and the wiper cleaners by driving a single motor in one direction. Plural drive sources (actuators) are therefore not needed to selectively wipe the nozzle faces of the fluid ejection head. A common actuator can also be used to drive the wipers and the wiper cleaners. Few parts are therefore required and device size can be reduced. Furthermore, because the direction the wiper cleaner moves intersects the direction the wiper moves, the ability to remove ink and other accretions from the wipers is greater than when simply sliding the wiper cleaner along the surface of the wiper. Device size can therefore be effectively reduced, performance removing ink and other accretions is excellent, and a wiper device suitable for selectively wiping the nozzle faces of a large fluid ejection head can be provided.

Preferably, the wiper unit has a first rotary cam that rotates according to rotation of the drive shaft and drives the wiper cleaner in the cleaning operation; the first rotary cam moves the wiper cleaner in an opening operation from a closed position covering the top of the wiper at the retracted position to an open position not contacting the wiper in the wiping position, and a closing operation returning from the open position to the closed position; and the wiper cleaner configured to move in the opening operation through a path not contacting the wiper, and moves in the closing operation through a path contacting the wiper in the cleaning operation.

The wiper cleaner can thus be prevented from contacting the wiper when the wiper cleaner moves to the open position. Problems such as the wiper being plucked and ink and other accretions flung therefrom before wiping the nozzle face can therefore be prevented.

Further preferably, the wiper unit has a moving member configured to move in the direction of wiper movement in the wiping operation. The first rotary cam has a first cam part that moves the wiper cleaner between the closed position and the open position, and a second cam part that pushes the wiper cleaner by the moving member and moves the wiper cleaner on a path not contacting the wiper when moving from the closed position to the open position. When moving from the open position to the closed position, the wiper cleaner is not pushed by the moving member and moves on a path contacting the wiper.

By thus desirably shaping the cam and the moving member, the wiper cleaner can be moved on different paths on the outbound and return operations.

In another aspect of the invention, the wiper moves vertically toward the fluid ejection head in the wiping operation; and the wiper cleaner is supported pivotably on an axis crosswise to the vertical direction of wiper movement.

Thus comprised, the rocking wiper cleaner can be made to wipe and clean the distal end of the wiper protruding toward the fluid ejection head.

The wiper device in another aspect of the invention also has a first drive gear and a second drive gear that rotate in unison with the drive shaft; and a first intermittent gear that meshes with the first drive gear, and a second intermittent gear that meshes with the second drive gear. The first rotary cam is formed in unison with the first intermittent gear, and the second rotary cam configured to drive the wiper in the wiping operation is formed in unison with the second intermittent gear.

When there are two intermittent gear unit set is, the two intermittent gears can be made to mesh with the drive gears at a specific phase difference by connecting the intermittent gear units by a cam mechanism so that rotation is transmitted when the intermittent gear units are at a specific rotational position.

The wipers and wiper cleaners can therefore be sequentially operated based on rotation of the drive shaft in one direction using a compact construction of gears arranged along the drive shaft.

In another aspect of the invention, the wiper cleaner has a cleaning part that slides against the wiper; a slide part is positioned in front of the direction of movement of the cleaning part; and the cleaning part slides against the slide part after sliding against the wiper in the cleaning operation.

Thus comprised, ink and other accretions transferred to the wiper cleaner can be removed from the wiper cleaner by the slide part. The cleaning performance of the wiper cleaner can therefore be maintained, and the ability of the wiper to remove ink and other accretions from the nozzle face can be maintained as a result.

The wiper device according to another aspect of the invention also has an ink sponge to hold ink wiped by the wiper; and a fluid path member forming an ink path from the slide part to the ink sponge.

Thus comprised, ink moved from the wiper cleaner to the slide part can be made to permeate the fluid path member and travel therethrough to the ink sponge. Ink dripping from the slide part to other internal parts of the wiper device can therefore be suppressed, and ink that has been wiped from the nozzle faces can be effectively collected.

Further preferably in another aspect of the invention, the wiper is shaped convexly toward the front in the direction the wiper slides against the wiper cleaner; and the wiper cleaner is concavely shaped in the part opposite the convex shape of the wiper.

Thus comprised, the wiper being depressed when cleaning and unable to remove ink and other accretions can be suppressed. A gap is also not formed between the cleaning part and the wiper cleaner when cleaning the wiper cleaner and the surface of the wiper can be wiped with the cleaning part tight to the wiper surface. The ability of the wiper cleaner to remove ink and other accretions from the wiper therefore remains excellent.

Another aspect of the invention is a fluid ejection device including: a fluid ejection head; and the wiper device described above. The plural wiper units are disposed to the wiper device at positions enabling wiping some nozzle faces of the fluid ejection head.

Effect of the Invention

A wiper and a wiper cleaner can be sequentially operated by rotation of a single motor in one direction. A common actuator can therefore be used for the wiper and wiper cleaner. Furthermore, because the wiper cleaner moves in a direction crossing the direction of wiper movement, ink and other accretions can be reliably and effectively removed from the wiper. A wiper device that can be rendered small while providing excellent performance removing ink and other accretions can therefore be provided.

Other objects and attainments together with a fuller understanding of the invention will become apparent and appreciated by referring to the following description and claims taken in conjunction with the accompanying drawings.

DESCRIPTION OF EMBODIMENTS

A wiper device and a fluid ejection device using the wiper device according to the invention are described below with reference to the accompanying figures. The embodiment described below applies the invention to the maintenance unit of an inkjet printer, but the invention can obviously be applied to fluid ejection devices that eject fluids other than ink. The embodiment described below is a printer having a line printhead, but the invention can also obviously be applied to printers having a serial printhead.

General Configuration

Figure 1:
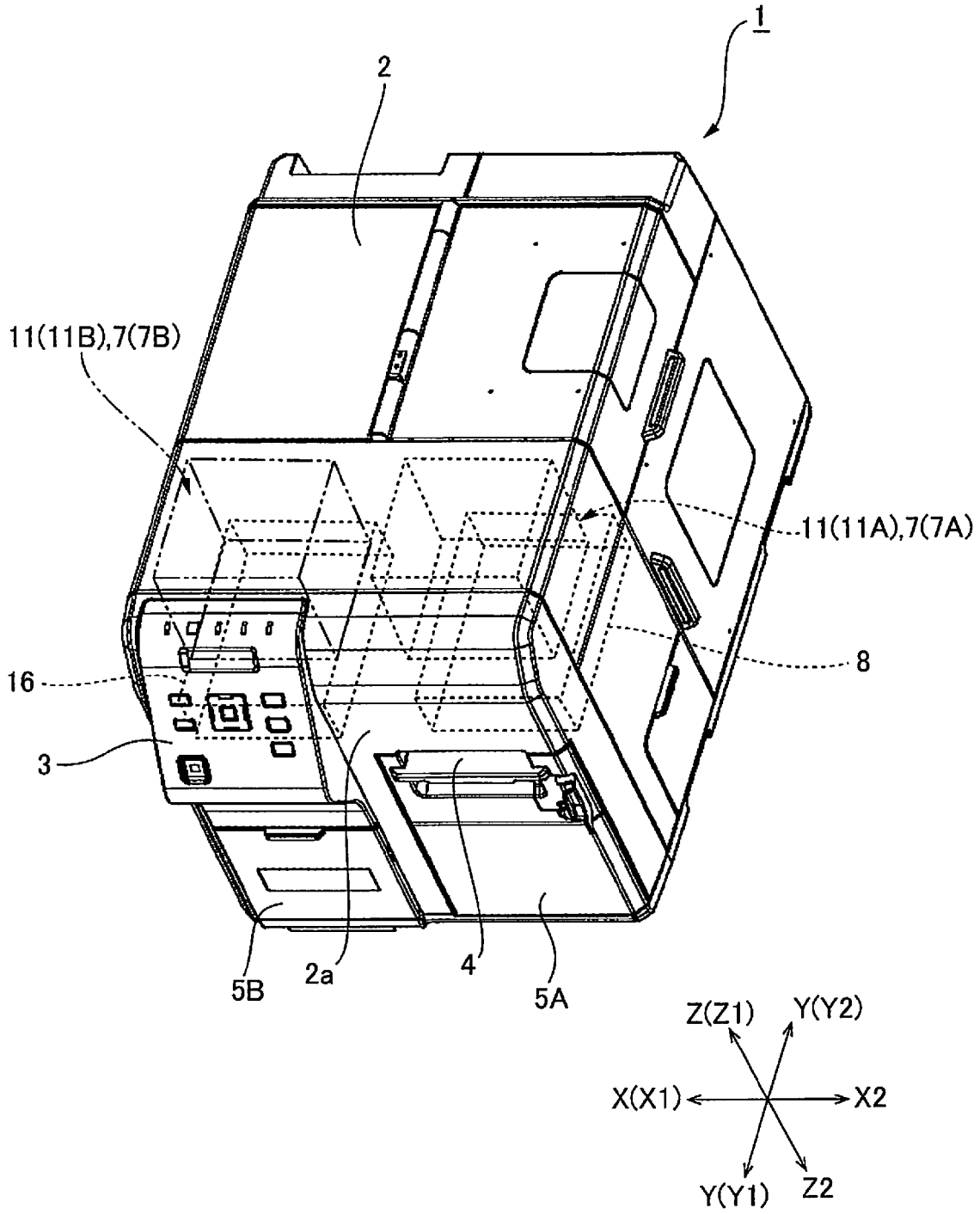
FIG. 1 is an external oblique view of a printer according to a preferred embodiment of the invention.
Figure 2:
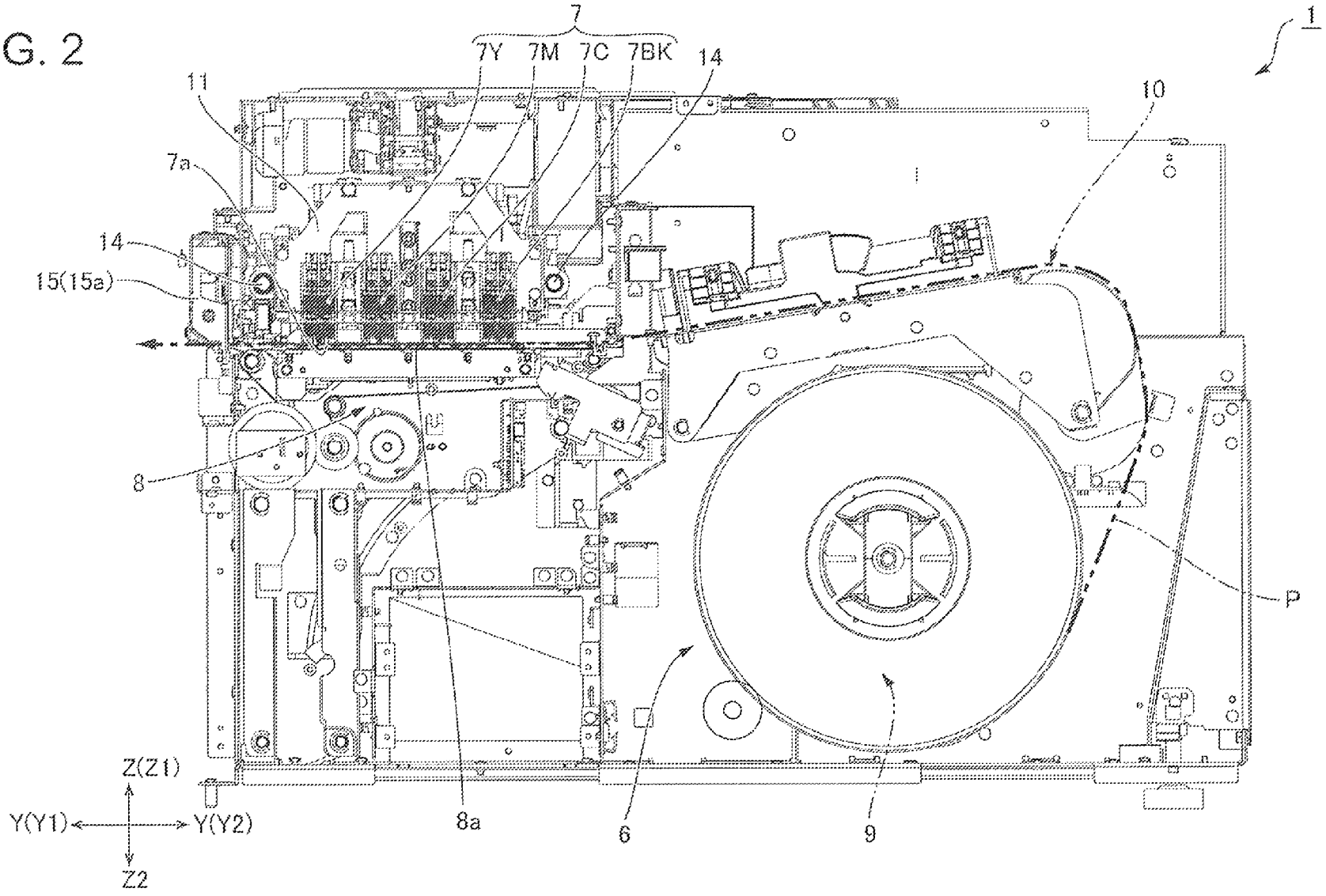
FIG. 2 is a vertical section view of the printer shown in FIG. 1.

FIG. 1 is an external oblique view of a printer according to the invention. FIG. 2 is a vertical section view of the printer.

As shown in FIG. 1, the printer 1 has a printer cabinet 2 that is basically box-shaped and is long from front to back.

As shown in FIG. 1, the invention is described below with reference to a transverse axis X across the device width, a longitudinal axis Y between the front and back of the device, and a vertical axis Z. Axes X, Y, and Z are mutually perpendicular. One side of the printer on the transverse axis X is denoted X1, and the other side is X2; Y1 denotes the front of the printer, and Y2 denotes the back of the printer; Z1 denotes the top and Z2 denotes the bottom of the printer.

An operating panel 3 is disposed at the top of the front 2*a* of the printer cabinet 2 on the one side X1, and a paper exit 4 is formed on the other side X2. An access cover 5A is disposed below the paper exit 4. Opening the access cover 5A opens the media conveyance path 10 (see FIG. 2). Below the operating panel 3 is another access cover 5B that opens and closes the ink cartridge loading unit (not shown in the figure). Four ink cartridges (not shown in the figure) storing four colors of ink, black ink Bk, cyan ink C, magenta ink M, and yellow ink Y, are installed in the ink cartridge loading unit.

As shown in FIG. 2, a roll paper compartment 6 is formed at the bottom at the back Y2 inside the printer cabinet 2. An inkjet head 7 (fluid ejection head) is disposed at the top of the printer front Y1, and a platen unit 8 is disposed below the inkjet head 7 at the front Y1. The inkjet head 7 is disposed with the nozzle face 7*a* where the nozzles are formed facing the platen surface 8*a*. Continuous recording paper P pulled from a paper roll 9 loaded in the roll paper compartment 6 is conveyed through a media conveyance path 10 indicated by the imaginary line, passes the print position of the inkjet head 7, and is discharged from the paper exit 4.

The inkjet head 7 is a line inkjet head, and includes four head units, head unit 7Bk, head unit 7C, head unit 7M, and head unit 7Y. The four head units are disposed at a regular interval on the longitudinal axis Y. The inkjet head 7 is mounted on a carriage 11. The carriage 11 moves between an opposing position 11A opposite the platen as denoted by the dotted line in FIG. 1, and a standby position 11B denoted by the double-dot dash line in FIG. 1, by means of a carriage moving mechanism 15 disposed at the printer front Y1. The carriage moving mechanism 15 includes a pair of timing pulleys (not shown in the figure), a timing belt (not shown in the figure), and a carriage motor 15*a*.

The pair of timing pulleys are disposed near the opposite ends of the carriage guide rails 14. The timing belt is mounted on the pair of timing pulleys, and the timing belt is fastened at one place to the carriage 11. When the carriage motor 15*a* is driven, one of the timing pulleys turns and the timing belt moves. As a result, the carriage 11 moves bidirectionally on the transverse axis X along the pair of carriage guide rails 14.

When the carriage 11 is at the opposing position 11A, the inkjet head 7 mounted on the carriage 11 is opposite the recording paper P conveyed over the platen surface 8*a*. This is the printing position 7A of the inkjet head 7.

When the carriage 11 is at the standby position 11B, the inkjet head 7 is opposite the head maintenance unit 16 disposed therebelow. This is the maintenance position 7B.

The carriage 11, carriage guide rails 14, and carriage moving mechanism 15 thus embody a head moving mechanism (head moving device) that moves the inkjet head 7 bidirectionally between the printing position 7A and maintenance position 7B.

Ink Nozzle Arrangement

Figure 3:
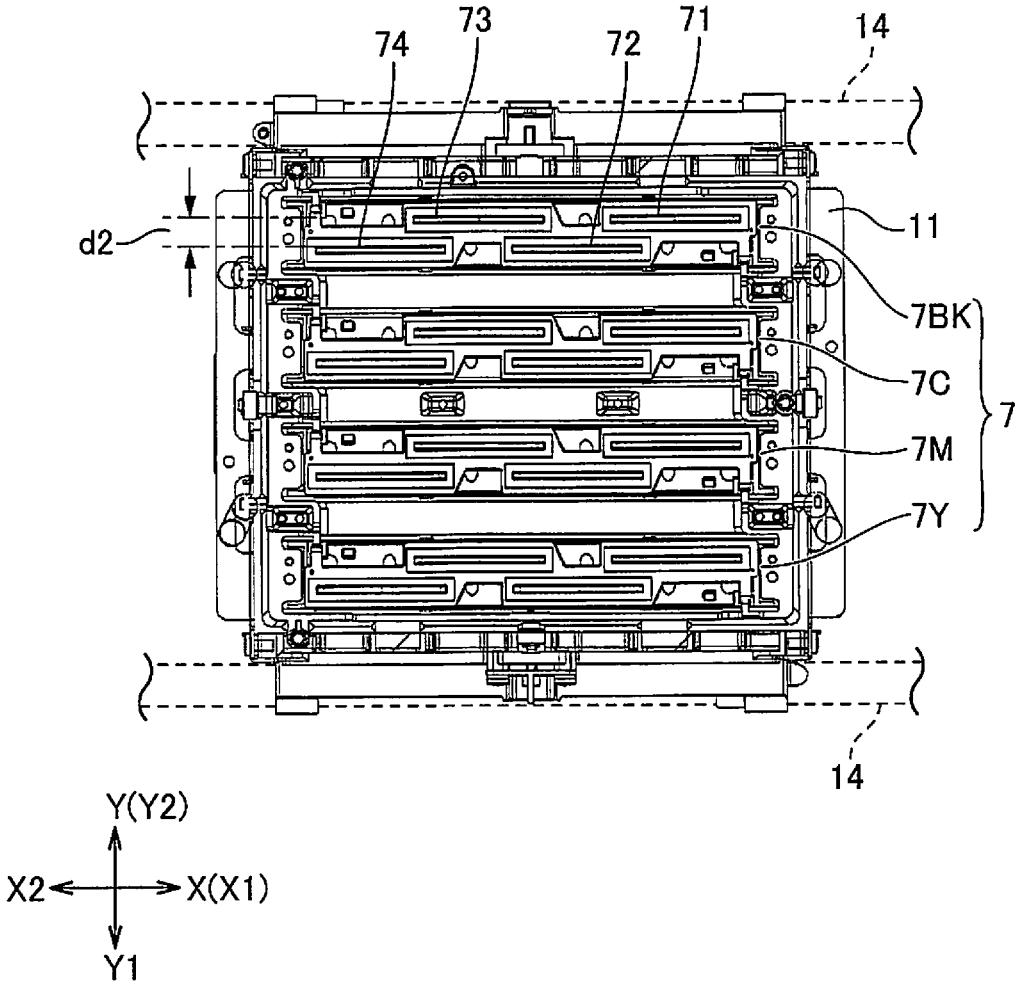
FIG. 3 is a bottom view of the inkjet head from the bottom of the printer.

FIG. 3 is a bottom view of the inkjet head 7 from the bottom Z2 side of the printer. As described above, the inkjet head 7 includes head unit 7Bk, head unit 7C, head unit 7M, and head unit 7Y. Each of these four head units is long and narrow on the transverse axis X, and includes four unit heads 71 to 74 disposed along the transverse axis X. The four unit heads 71 to 74 alternate front and back on the longitudinal axis Y with the adjacent unit head, forming two lines in each head unit. The unit heads 71 and 73 form a line on the side toward the front Y1 of the printer, and unit heads 72 and 74 form a line on the side toward the back Y2 of the printer. The corresponding ends of the unit heads adjacent on the transverse axis X overlap each other on the longitudinal axis Y.

Plural ink nozzles arrayed at a specific nozzle pitch on the transverse axis X are formed in two ink nozzle rows in each of the four unit heads 71 to 74. Ink nozzles that eject black ink Bk are formed in the unit heads 71 to 74 of head unit 7Bk. Ink nozzles that eject cyan ink C are formed in the unit heads 71 to 74 of head unit 7C. Ink nozzles that eject magenta ink M are formed in the unit heads 71 to 74 of head unit 7M. Ink nozzles that eject yellow ink Y are formed in the unit heads 71 to 74 of head unit 7Y.

Maintenance Unit

Figure 4:
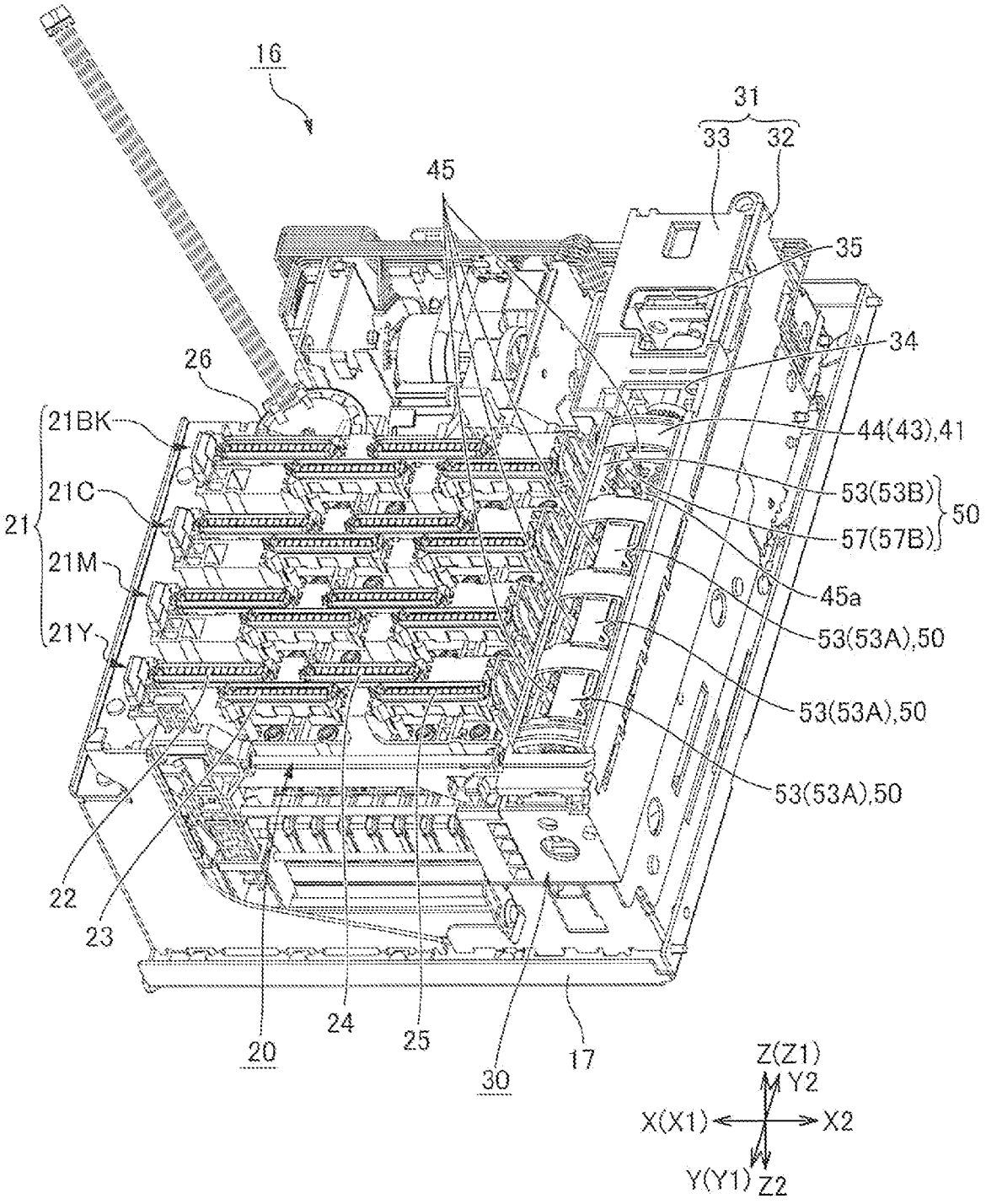
FIG. 4 is an oblique view of the maintenance unit.

FIG. 4 is an oblique view of the maintenance unit 16. The maintenance unit 16 has a suction unit 20 and a wiper device 30. The suction unit 20 caps the nozzle face 7*a* of the inkjet head 7 and suctions ink from the nozzles. The wiper device 30 wipes accretions of ink and other foreign matter from the nozzle face 7*a* of the inkjet head 7. As shown in FIG. 4, the suction unit 20 and wiper device 30 are disposed side by side on the transverse axis X, and are supported on a rectangular base frame 17. When the inkjet head 7 is at the maintenance position 7B, the nozzle face 7*a* of the inkjet head 7 is opposite the suction unit 20. The wiper device 30 is disposed on the platen unit 8 side of the suction unit 20. As a result, when the inkjet head 7 moves between the maintenance position 7B and the printing position 7A, the nozzle face 7*a* of the inkjet head 7 moves over the wiper device 30.

Suction Device

The suction unit 20 includes a head cap 21, a lift mechanism (not shown in the figure) that moves the head cap 21 on the vertical axis Z, a waste ink tank (not shown in the figure), a waste ink tube (not shown in the figure), and a suction pump 26. The head cap 21 includes cap units 21Bk, 21C, 21M, and 21Y. Each cap unit has unit caps 22 to 25. The four unit caps 22 to 25 oppose the four unit heads 71 to 74 on the head unit side. The unit caps 22 to 25 are connected to a waste ink tank through a waste ink tube. During maintenance and when the inkjet head 7 enters the standby mode, the head cap 21 rises and caps the unit heads 71 to 74 with the unit caps 22 to 25.

The printer 1 performs flushing and ink suction operations to prevent or resolve clogging caused by increased viscosity of the ink in the ink nozzles of the inkjet head 7.

Flushing is an operation that moves the inkjet head 7 to the maintenance position 7B and ejects ink into the head cap 21. The ink that is ejected by flushing is held in ink sponges disposed inside the unit caps 22 to 25.

For the ink suction operation, the suction pump 26 is driven while the unit heads 71 to 74 are capped with the unit caps 22 to 25. This creates negative pressure in the sealed space around the ink nozzles, and suctions ink that has increased in viscosity from inside the nozzles. The suctioned ink is recovered with the ink ejected into the ink sponge through the waste ink tube into the waste ink tank.

Wiper Device

Figure 5:
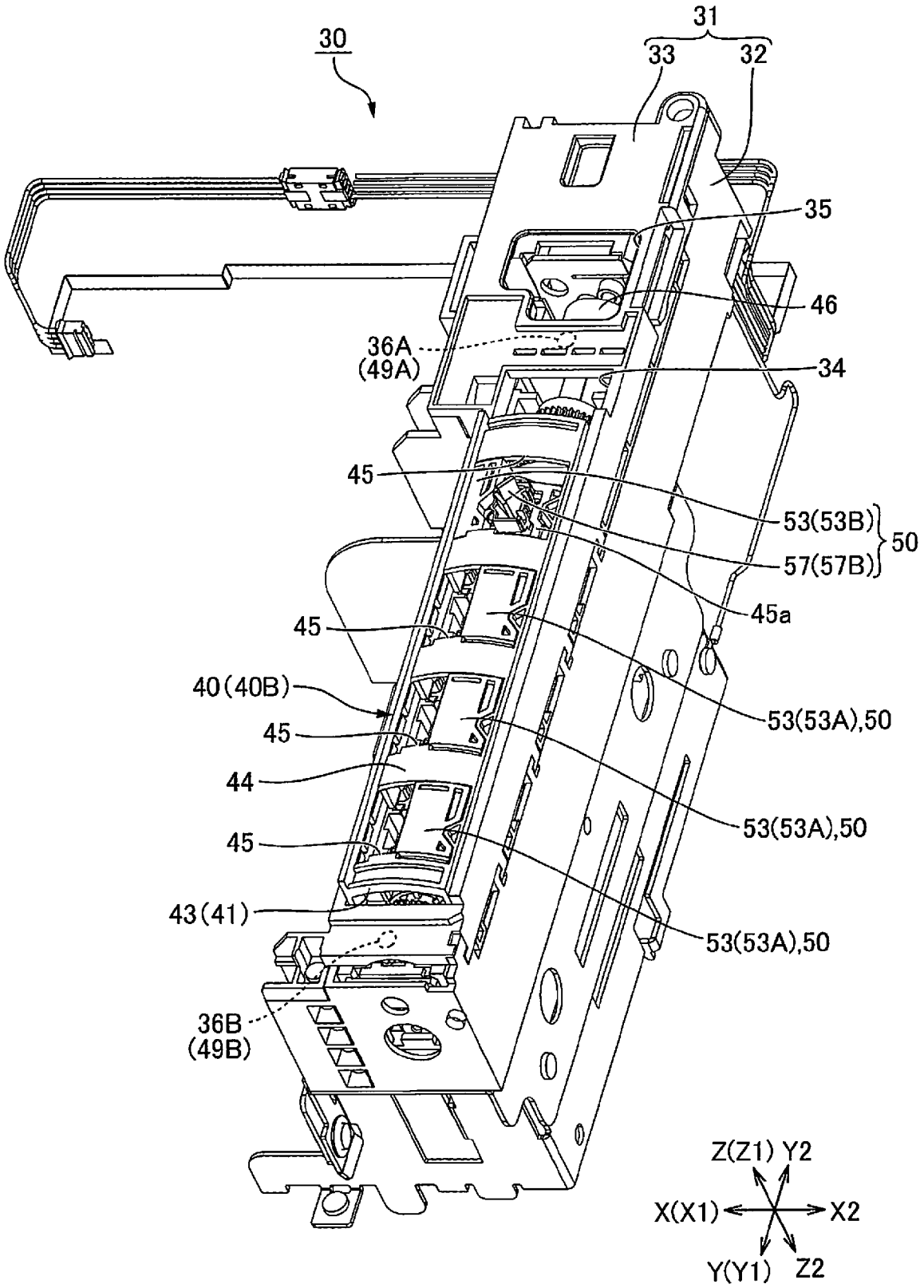
FIG. 5 is an oblique view of the wiper device.
Figure 6A:
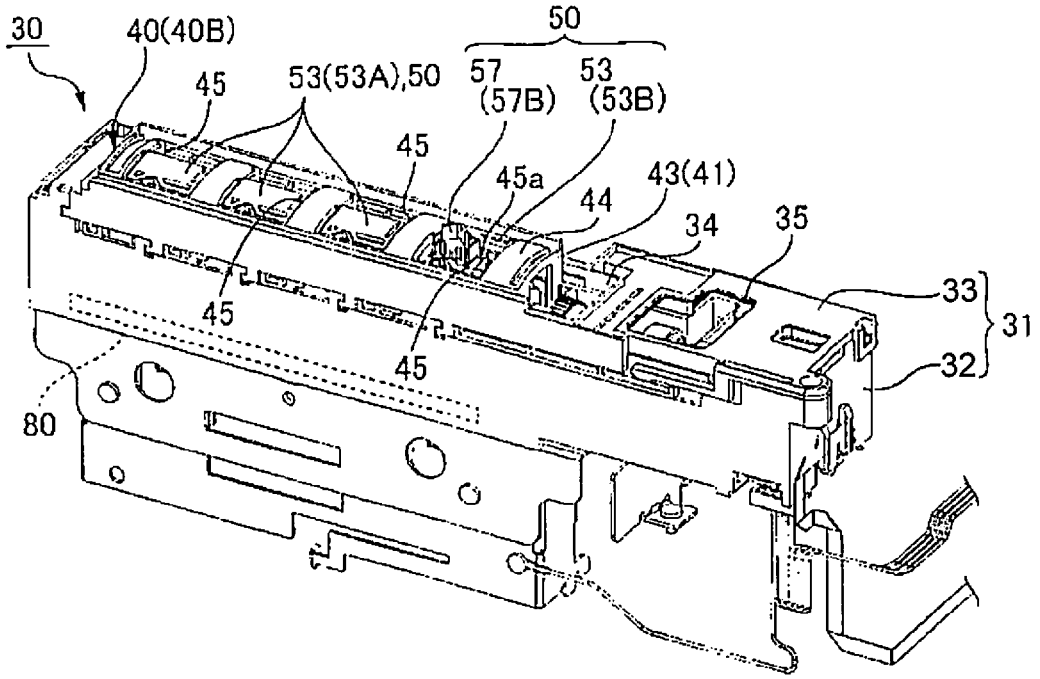
FIGS. 6A and 6B are oblique views of the wiper device and moving unit.
Figure 6B:
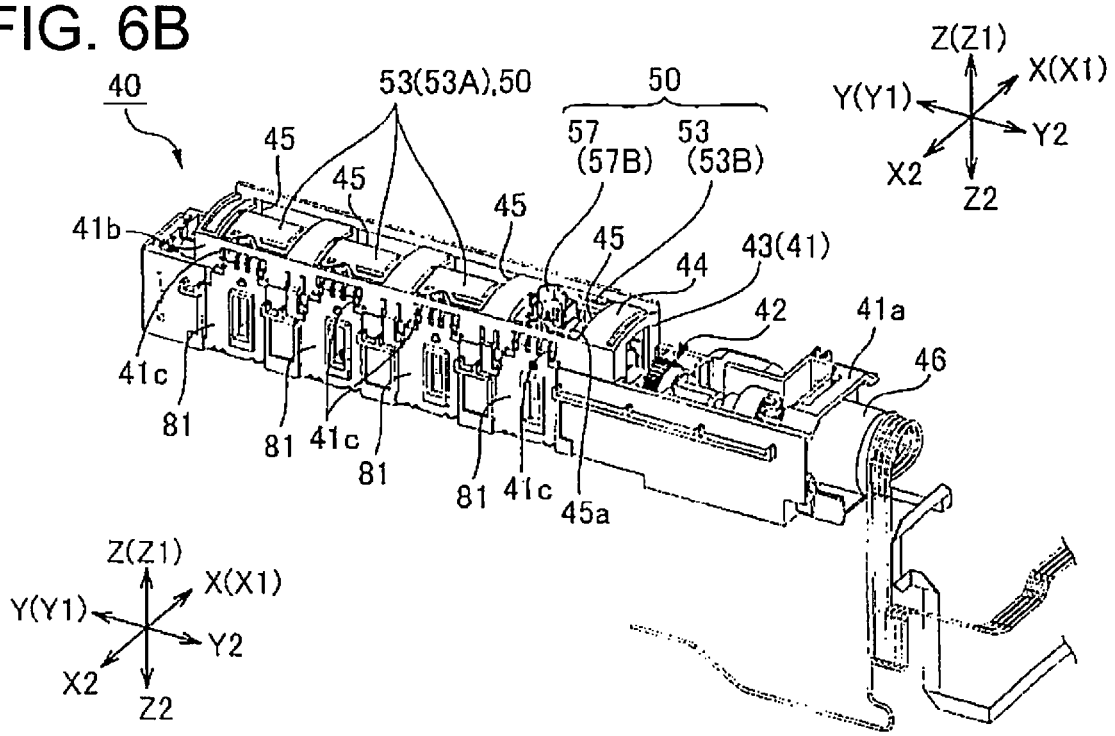

FIG. 5 is an oblique view of the wiper device 30 from the front Y1 side. FIG. 6 is an oblique view of the wiper device 30 and wiper moving unit 40, FIG. 6 (*a*) showing the wiper device 30 from the other side X2 (platen unit 8 side) on the transverse axis X, and FIG. 6 (*b*) showing the wiper device 30 with the outside case of the wiper device removed (more specifically, showing the wiper moving unit 40). As shown in FIG. 5 and FIG. 6, the wiper device 30 has an outside case 31 (second case) that is long on the longitudinal axis Y, and a wiper moving unit 40 housed inside the outside case 31. The wiper moving unit 40 is supported by the outside case 31 movably on the longitudinal axis Y. The wiper unit 50 described below is disposed to a position on the front Y1 side of the wiper moving unit 40.

The outside case 31 has a box-shaped bottom case 32 rendering the bottom and side walls, and a cover case 33 rendering the top of the case.

The cover case 33 is removably installed with screws or other fasteners to the bottom case 32. An opening 34 extending on the longitudinal axis Y is formed in the cover case 33 beside the head cap 21 on the transverse axis X.

A window 35 is also formed in the cover case 33 on the back Y2 side of the opening 34. A first cam pin 36A and a second cam pin 36B (see FIG. 5) are formed on the opposite sides of the opening 34 on the longitudinal axis Y. The first cam pin 36A is disposed on the back Y2 side of the opening 34, and the second cam pin 36B is disposed on the front Y1 side of the opening 34. The first cam pin 36A and second cam pin 36B protrude into the case from the back side of the cover case 33. These cam pins and a spiral cam described further below together render a moving mechanism that moves the wiper moving unit 40 on the longitudinal axis Y inside the outside case 31.

As shown in FIG. 6 (*b*), the wiper moving unit 40 includes an inside case 41 (first case) and an internal mechanism 42 supported in the inside case 41. The inside case 41 is supported movably on the longitudinal axis Y by the outside case 31. A protruding part 43 that projects to the top Z1 from the opening 34 is formed in the inside case 41 at a position overlapping the opening 34 in the outside case 31. The top of the protruding part 43 is a gently curved surface 44 that when seen in section on the longitudinal axis Y protrudes toward the top Z1. Four openings 45 are formed in the curved surface 44 at a regular interval on the longitudinal axis Y. These four openings 45 are formed at positions adjacent on the transverse axis X to the cap units 21Bk, 21C, 21M, and 21Y of the suction unit 20. The wipers 57 of the wiper unit 50 described further below are located in these four openings 45.

Internal Mechanism of the Wiper Device

Figure 7:
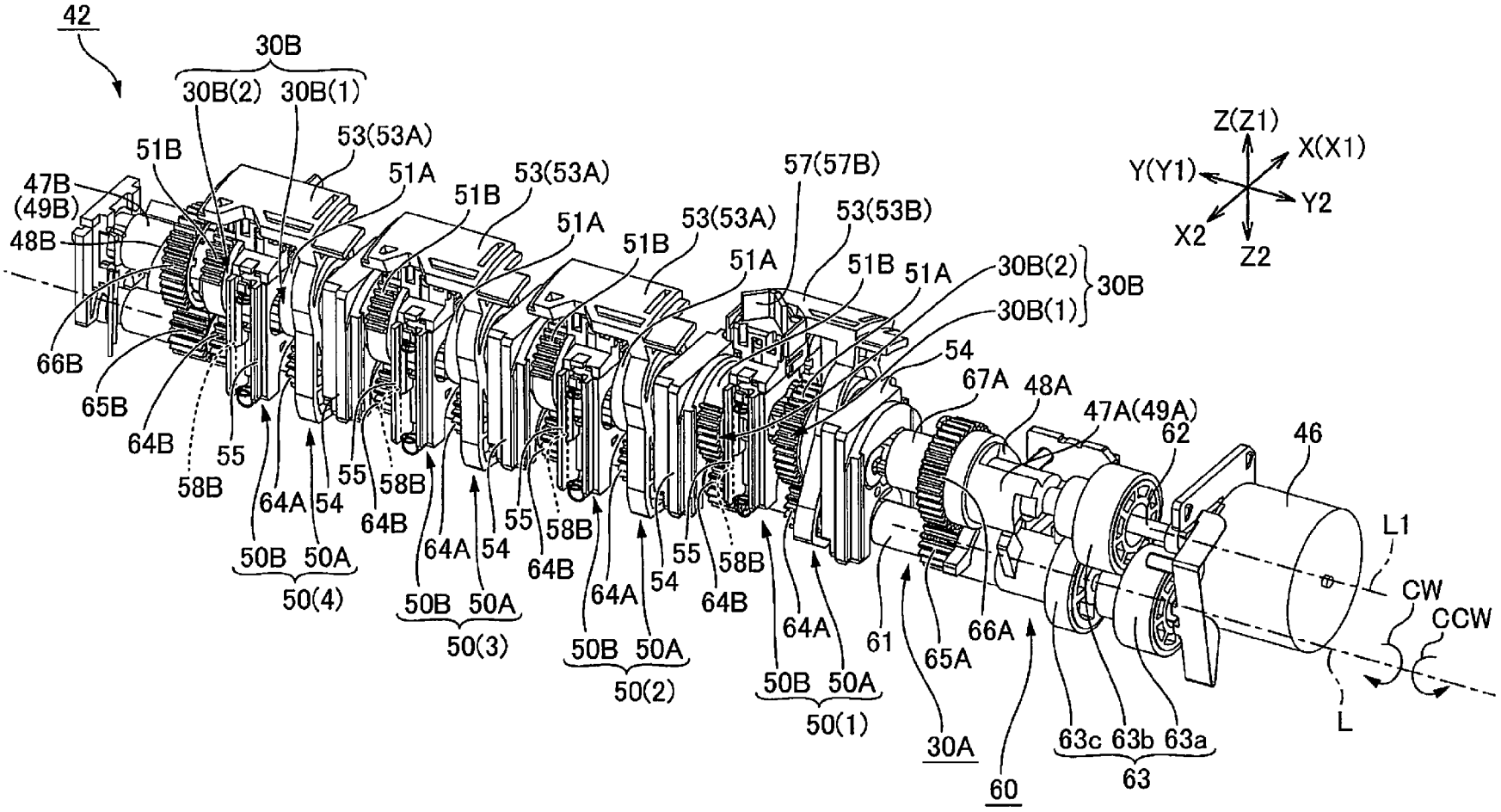
FIG. 7 is an oblique view of the internal mechanism of the wiper device.

FIG. 7 is an oblique view of the internal mechanism 42 of the wiper device 30. The internal mechanism 42 includes four wiper units 50 arrayed in a line on the longitudinal axis Y, a drive power transfer mechanism 60, a wiper motor 46, and a first spiral cam 47A, and a second spiral cam 47B disposed to the opposite ends of the line of four wiper units 50. As shown in FIG. 6 (*b*), a motor mount 41*a* is disposed at the back Y2 end of the inside case 41, and the wiper motor 46 is attached thereto. The drive power transfer mechanism 60 includes a drive shaft 61 and a support shaft 62, a speed reducer 63, a first drive gear 64A, a second drive gear 64B, a third drive gear 65A, and a fourth drive gear 65B.

The drive shaft 61 and support shaft 62 extend parallel to the longitudinal axis Y.

The speed reducer 63 reduces the speed of and transfers the output rotation of the wiper motor 46 to the drive shaft 61. The speed reducer 63 is a gear train including a first gear 63*a* that meshes with a pinion (not shown in the figure) attached to the output shaft of the wiper motor 46; a second gear 63*b* that meshes with the small diameter gear part of the first gear 63*a*; and a third gear 63*c* that meshes with the small diameter gear part of the second gear 63*b*. The drive shaft 61 rotates in unison with the third gear 63*c*. The first gear 63*a* is rotatably attached to the drive shaft 61, and the second gear 63*b* is rotatably attached to the support shaft 62. The speed reducer 63 and wiper motor 46 are disposed to the back Y2 end of the drive shaft 61.

There are four first drive gear 64A and second drive gear 64B sets, and the four sets are disposed sequentially with each first drive gear 64A followed by the second drive gear 69B from the back Y2 to the front Y1 end of the drive shaft 61.

The third drive gear 65A and the fourth drive gear 65B are disposed on the opposite sides of the four drive gear sets on the longitudinal axis Y. The third drive gear 65A is disposed on the back Y2 side of the four drive gear sets, and the fourth drive gear 65B is on the front Y1 side. The four first drive gear 64A and second drive gear 64B sets, and the third drive gear 65A and fourth drive gear 65B on the opposite sides thereof, rotate in unison with the drive shaft 61.

The support shaft 62 is disposed to the top Z1 side of the drive shaft 61. The wiper unit 50 has four first intermittent gear 51A and second intermittent gear 51B sets, which are attached to the support shaft 62.

The first intermittent gear 51A is disposed to mesh with the first drive gear 64A of the drive power transfer mechanism 60, and the second intermittent gear 51B is disposed to mesh with the second drive gear 64B of the drive power transfer mechanism 60.

A third intermittent gear 66A and a fourth intermittent gear 66B are disposed to the support shaft 62 on the opposite sides of the four intermittent gear sets on the longitudinal axis Y. The third intermittent gear 66A meshes with the third drive gear 65A, and the fourth intermittent gear 66B meshes with the fourth drive gear 65B. The four first intermittent gear 51A and second intermittent gear 51B sets, and the third intermittent gear 66A and a fourth intermittent gear 66B disposed on the opposite sides thereof, can rotate relative to the support shaft 62.

The first intermittent gear 51A, second intermittent gear 51B, third intermittent gear 66A, and fourth intermittent gear 66B each have a toothed portion where teeth are formed, and a toothless portion where teeth are not formed, in specific ranges around the circumference.

As described above, the drive shaft 61 and support shaft 62 are disposed with their axes on the longitudinal axis Y. In the following description, the direction of rotation that is counterclockwise rotation when looking toward the front Y1 is referred to as the first direction of rotation CCW, and the direction of rotation that is clockwise rotation when looking toward the front Y1 is referred to as the second direction of rotation CW (see FIG. 7).

The drive shaft 61 rotates on its axis of rotation L in the first direction of rotation CCW and the second direction of rotation CW based on rotation of the wiper motor 46. When the drive shaft 61 turns in the first direction of rotation CCW, the intermittent gears attached to the support shaft 62 are turned by the drive gears in the second direction of rotation CW on the axis of rotation L1 of the support shaft 62. When the drive shaft 61 turns in the second direction of rotation CW, the intermittent gears are turned in the first direction of rotation CCW.

Moving Mechanism of the Wiper Moving Unit

Figure 8:
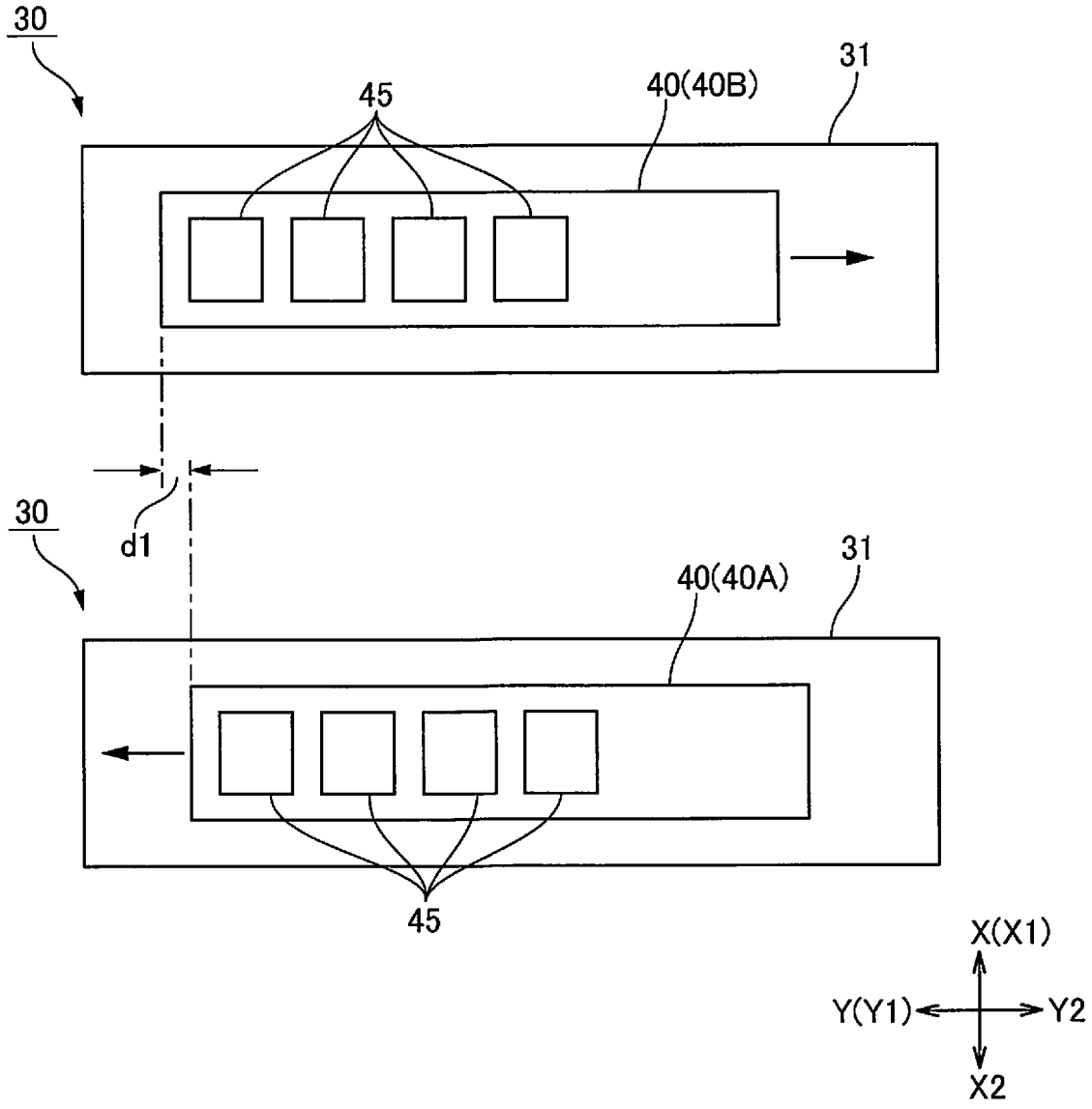
FIG. 8 illustrates the operation of the moving unit by the first and second moving mechanisms.

FIG. 8 schematically illustrates the position of the wiper moving unit 40 in the outside case 31. As shown in the figure, the wiper moving unit 40 can move between a back position 40A closer to the back Y2 inside the outside case 31, and a front position 40B closer to the front Y1. When the wiper moving unit 40 is at the back position 40A, the protruding part 43 (see FIG. 5, FIG. 6) where the wipers 57 are disposed in the wiper moving unit 40 is positioned near the back Y2 end of the opening 34 in the cover case 33. When the wiper moving unit 40 is at the front position 40B, the protruding part 43 is positioned near the front Y1 end of the opening 34.

As shown in FIG. 7, the first spiral cam 47A disposed to a position on the back Y2 side of the internal mechanism 42 is rotatably attached relative to the support shaft 62, and rotates in unison with the third intermittent gear 66A. A first spiral channel 48A is formed in the outside surface of the first spiral cam 47A. The first cam pin 36A of the cover case 33 described above is disposed in the first spiral channel 48A. The first spiral channel 48A is a channel with a spiral surface only on the front Y1 side. A face that contacts the first cam pin 36A is formed on both circumferential ends of the first spiral channel 48A.

When the drive shaft 61 turns in the second direction of rotation CW, the third intermittent gear 66A turns in the first direction of rotation CCW, and the first spiral cam 47A turns therewith in the first direction of rotation CCW. In this event, the first spiral cam 47A is moved to the front Y1 side by the first cam pin 36A. As a result, the entire wiper moving unit 40 moves to the front Y1 side in the outside case 31.

The first spiral cam 47A and first cam pin 36A thus embody a first moving mechanism 49A that moves the entire wiper moving unit 40 to the front Y1 side.

The second spiral cam 47B disposed to a position on the front Y1 side of the internal mechanism 42 is relatively rotatably attached to the support shaft 62, and rotates in unison with the fourth intermittent gear 66B. The second spiral cam 47B and fourth intermittent gear 66B are configured in reverse orientation to the first spiral cam 47A and third intermittent gear 66A on the longitudinal axis Y. More specifically, a second spiral channel 48B is formed on the outside surface of the second spiral cam 47B.

The second cam pin 36B of the cover case 33 described above is fit in the second spiral channel 48B. The second spiral channel 48B has a spiral face only on the back Y2 side. A surface that contacts the second cam pin 36B is formed on both circumferential ends of the second spiral channel 48B.

When the drive shaft 61 turns in the first direction of rotation CCW, the fourth intermittent gear 66B rotates in the second direction of rotation CW, and the second spiral cam 47B also turns therewith in the second direction of rotation CW. At this time the second spiral cam 47B is moved to the back Y2 side by the second cam pin 36B. As a result, the entire wiper moving unit 40 moves to the back Y2 side in the outside case 31.

The second spiral cam 47B and second cam pin 36B thus form a second moving mechanism 49B that moves the entire wiper moving unit 40 to the back Y2 side.

The distance d1 (see FIG. 8) the wiper moving unit 40 moves by the first moving mechanism 49A and the second moving mechanism 49B matches the gap d2 (see FIG. 3) on the longitudinal axis Y between the four unit heads 71 to 74 arranged in two rows in the head units of the inkjet head 7.

When the wiper moving unit 40 is at the back position 40A, the wipers 57 in the four openings 45 can wipe the nozzle faces of the unit heads 71 and 73 forming the head row on the back Y2 side in each head unit. When the wiper moving unit 40 is at the front position 40B, the wipers 57 in the four openings 45 can wipe the nozzle faces of the unit heads 72 and 74 forming the head row on the front Y1 side in each head unit.

The wiper device 30 thus has plural wipers 57 that can wipe rows of different unit heads. Even though the number of rows of unit heads (8 rows) is greater than the number (4) of wipers 57, the nozzle faces of all head rows can be selectively wiped by moving the wiper moving unit 40 on the longitudinal axis Y.

Operating Sequence of the Wiper Device

The four wiper units 50 of the wiper device 30 are driven one at a time and operate sequentially in the order in which they are arranged. The operating sequence includes an outbound sequence in which the four wiper units 50 are driven sequentially from the back Y2 side to the front Y1 side, and a return sequence in which the four wiper units 50 are driven sequentially from the front Y1 side to the back Y2 side. As described further below, the outbound sequence starts by the first intermittent gear 51A located at the back Y2 end of the wiper unit 50 array turning in the second direction of rotation CW based on rotation of the adjacent third intermittent gear 66A. The return sequence starts by the second intermittent gear 51B located at the front Y1 end of the wiper unit 50 array turning in the first direction of rotation CCW based on rotation of the adjacent fourth intermittent gear 66B.

Operation when the Drive Shaft Turns in the First Direction of Rotation CCW

When the drive shaft 61 of the wiper device 30 turns in the first direction of rotation CCW, the outbound operating sequence of the four wiper units 50 executes with the wiper moving unit 40 at the back position 40A, and the wiper moving unit 40 then slides to the back Y2 side (moves from the back position 40A to the front position 40B).

First, when the drive shaft 61 turns in the first direction of rotation CCW, the third intermittent gear 66A and first spiral cam 47A are turned in the second direction of rotation CW by the third drive gear 65A.

Because the first cam pin 36A turns freely in the first spiral channel 48A at this time, the wiper moving unit 40 does not move from the front position 40B. When the third intermittent gear 66A reaches a specific rotational position, the cam mechanism disposed between the third intermittent gear 66A and the first intermittent gear 51A located at the end of the wiper unit 50 array (the end on the back Y2 side) engages. As a result, the first intermittent gear 51A turns based on rotation of the third intermittent gear 66A. The first intermittent gear 51A then moves from not engaging the first drive gear 64A in the idle phase, to meshing with the first drive gear 64A.

The cam mechanism disposed between the third intermittent gear 66A and the first intermittent gear 51A is configured as described below.

The third intermittent gear 66A has a protruding part 67A (see FIG. 7) that projects to the wiper unit 50 side. A cam member (not shown in the figure) is formed on the distal end of the protruding part 67A. This cam member has the same shape as the seventh cam part 55*d* (see FIG. 10) of the second rotary cam 55 described further below, and at one place on the inside circumference side of a circular recess has a protrusion projecting to the inside from the inside surface. Inserted to this cam member is a third cam part 52*c* (see FIG. 9, FIG. 11) of the first rotary cam 52 that rotates in unison with the first intermittent gear 51A. When these cam members engage, rotation of the third intermittent gear 66A is transferred to the first intermittent gear 51A.

The toothless phase of the first intermittent gear 51A and third intermittent gear 66A is set so that the third intermittent gear 66A and third drive gear 65A disengage and go idle when the first intermittent gear 51A rotates a specific angle (such as 30 degrees) after starting to turn based on rotation of the third intermittent gear 66A.

If the drive shaft 61 continues to turn in the first direction of rotation CCW after the first intermittent gear 51A meshes with the first drive gear 64A, the four wiper units 50 are driven sequentially in the outbound sequence operation. This operating sequence is described in detail below. When the outbound operating sequence ends, the second intermittent gear 51B located at the front Y1 side end in the array of four wiper units 50 turns last. Rotation of the second intermittent gear 51B is transferred to the fourth intermittent gear 66B.

Rotation is transferred from the second intermittent gear 51B to the fourth intermittent gear 66B by a cam mechanism identical to the cam mechanism disposed between the third intermittent gear 66A and first intermittent gear 51A. More specifically, a cam member (not shown in the figure) that protrudes to the wiper unit 50 side is formed on the back Y2 side surface of the fourth intermittent gear 66B. This cam member has the same shape as the third cam part 52*c* of the first rotary cam 52 (see FIG. 9, FIG. 11). This cam member is disposed to the seventh cam part 55*d* (see FIG. 10) formed on the front Y1 side surface of the second intermittent gear 51B. When these cam members engage, rotation of the fourth intermittent gear 66B is transferred to the second intermittent gear 51B. The phase of the toothless parts of the second intermittent gear 51B and fourth intermittent gear 66B is set to the same phase as the toothless parts of the first intermittent gear 51A and third intermittent gear 66A. More specifically, the toothless phase is set so that the second intermittent gear 51B and second drive gear 64B disengage and go idle when the fourth intermittent gear 66B rotates a specific angle (such as 30 degrees) after starting to turn.

Following the outbound operating sequence of the wiper units 50, the fourth intermittent gear 66B and second spiral cam 47B start turning in the second direction of rotation CW. When the second spiral cam 47B turns in the second direction of rotation CW at the front position 40B, the second spiral cam 47B is pushed by the second cam pin 36B to the back Y2 side. As a result, the wiper moving unit 40 moves to the back position 40A.

Operation Based on Rotation of the Drive Shaft in the Second Direction of Rotation CW When the drive shaft 61 of the wiper device 30 turns in the second direction of rotation CW and the wiper moving unit 40 is at the front position 40B described above, the four wiper units 50 move in the return operating sequence. The wiper moving unit 40 then slides to the front Y1 side (moves from the front position 40B to the back position 40A).

When the drive shaft 61 turns in the second direction of rotation CW, the fourth drive gear 65B causes the fourth intermittent gear 66B and second spiral cam 47B to turn in the first direction of rotation CCW. Because the second cam pin 36B is idle in the second spiral channel 48B at this time, the wiper moving unit 40 does not move from the back position 40A.

When the fourth intermittent gear 66B reaches a specific rotational position, the cam mechanism between the fourth intermittent gear 66B and the second intermittent gear 51B at the end of the line of wiper units 50 (the end on the front Y1 side) engages. The second intermittent gear 51B therefore turns according to the rotation of the fourth intermittent gear 66B. As a result, the second intermittent gear 51B goes from not meshing with the second drive gear 64B in the idle phase, to meshing with the second drive gear 64B.

The phases of the cam mechanism between the fourth intermittent gear 66B and the second intermittent gear 51B, and the toothless parts of the second intermittent gear 51B and the fourth intermittent gear 66B, are as described in the outbound operating sequence above. Therefore, rotation of the fourth intermittent gear 66B stops soon after the second intermittent gear 51B starts turning at the beginning of the return operating sequence.

When the drive shaft 61 continues turning in the second direction of rotation CW after the second intermittent gear 51B meshes with the second drive gear 64B, the four wiper units 50 are driven sequentially in the return operating sequence. This operating sequence is described in detail below. When the return operating sequence ends, the first intermittent gear 51A located at the back Y2 side end of the four wiper units 50 turns last. Rotation of the first intermittent gear 51A is transferred by the cam mechanism to the third intermittent gear 66A.

The phases of the cam mechanism between the first intermittent gear 51A and the third intermittent gear 66A, and the toothless parts of the first intermittent gear 51A and the third intermittent gear 66A are as described in the outbound operating sequence above. Therefore, rotation of the first intermittent gear 51A stops soon after the third intermittent gear 66A starts turning at the beginning of the return operating sequence.

Rotation of the third intermittent gear 66A and first spiral cam 47A in the first direction of rotation CCW thus starts following the return operating sequence of the wiper units 50. When the first spiral cam 47A turns in the first direction of rotation CCW at the back position 40A, the first spiral cam 47A is pushed by the first cam pin 36A to the front Y1 side. As a result, the wiper moving unit 40 returns to the front position 40B.

Wiper Unit

Figure 9:
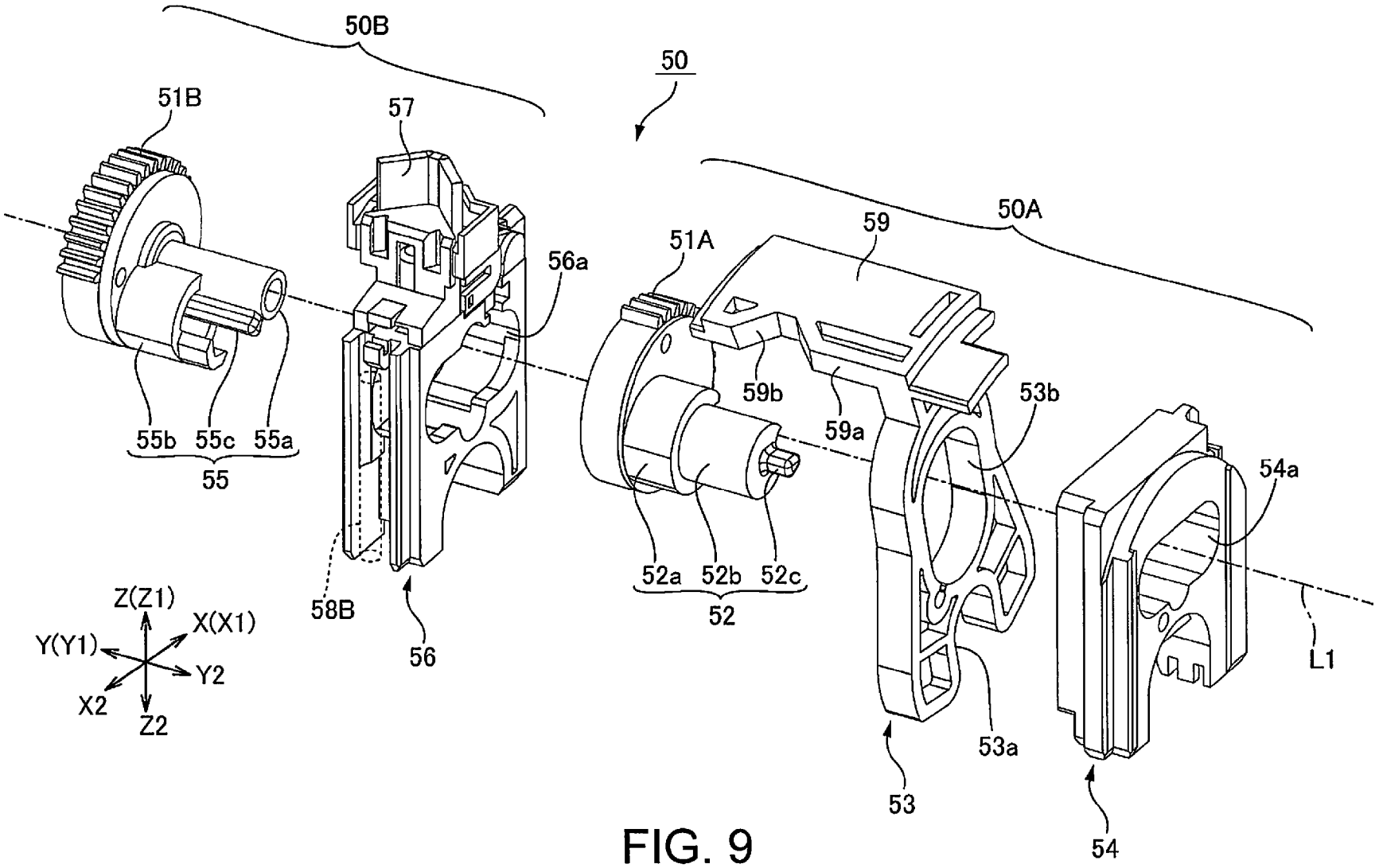
FIG. 9 is an exploded oblique view of the wiper unit.
Figure 10:
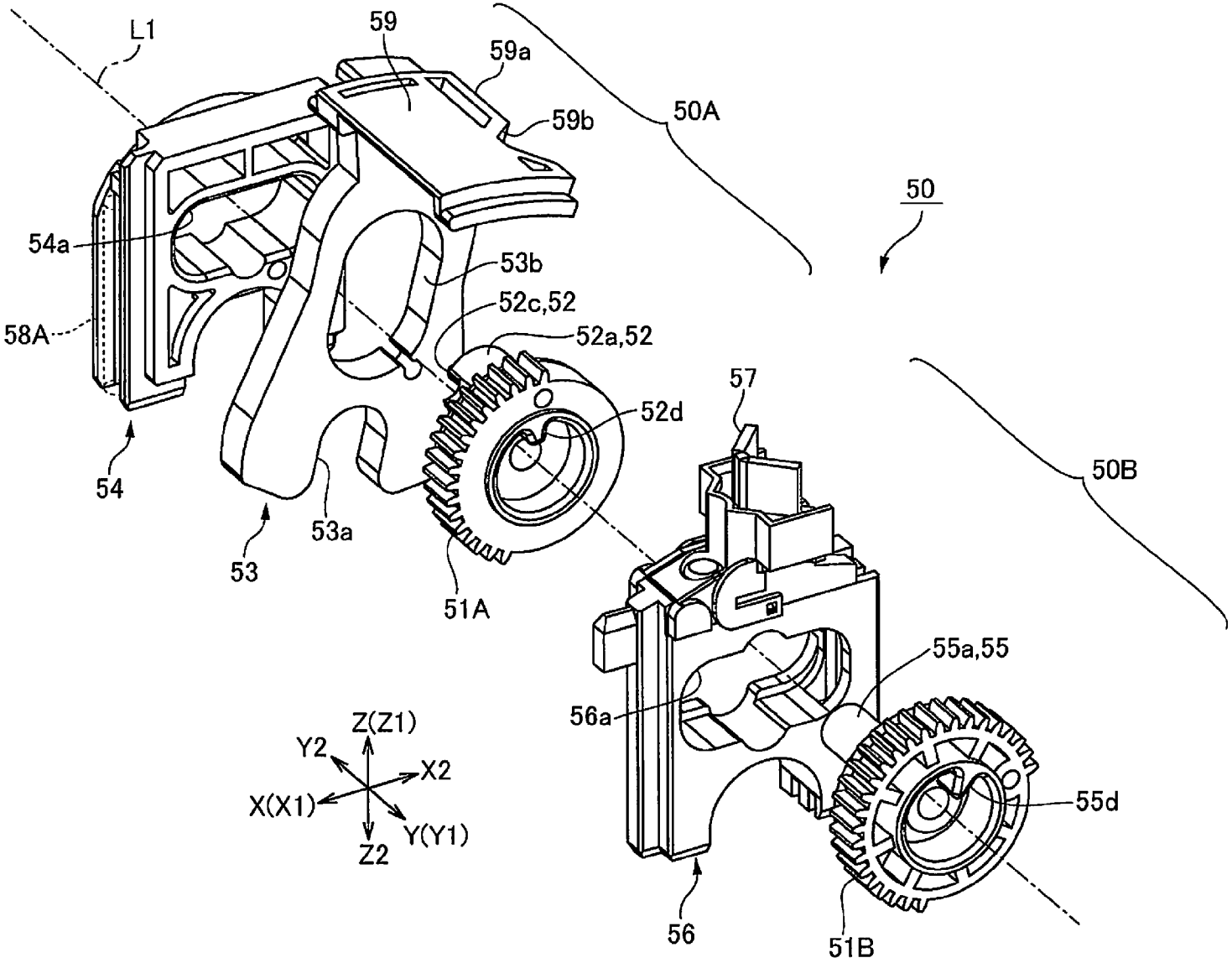
FIG. 10 is an exploded oblique view of the wiper unit.
Figure 11:
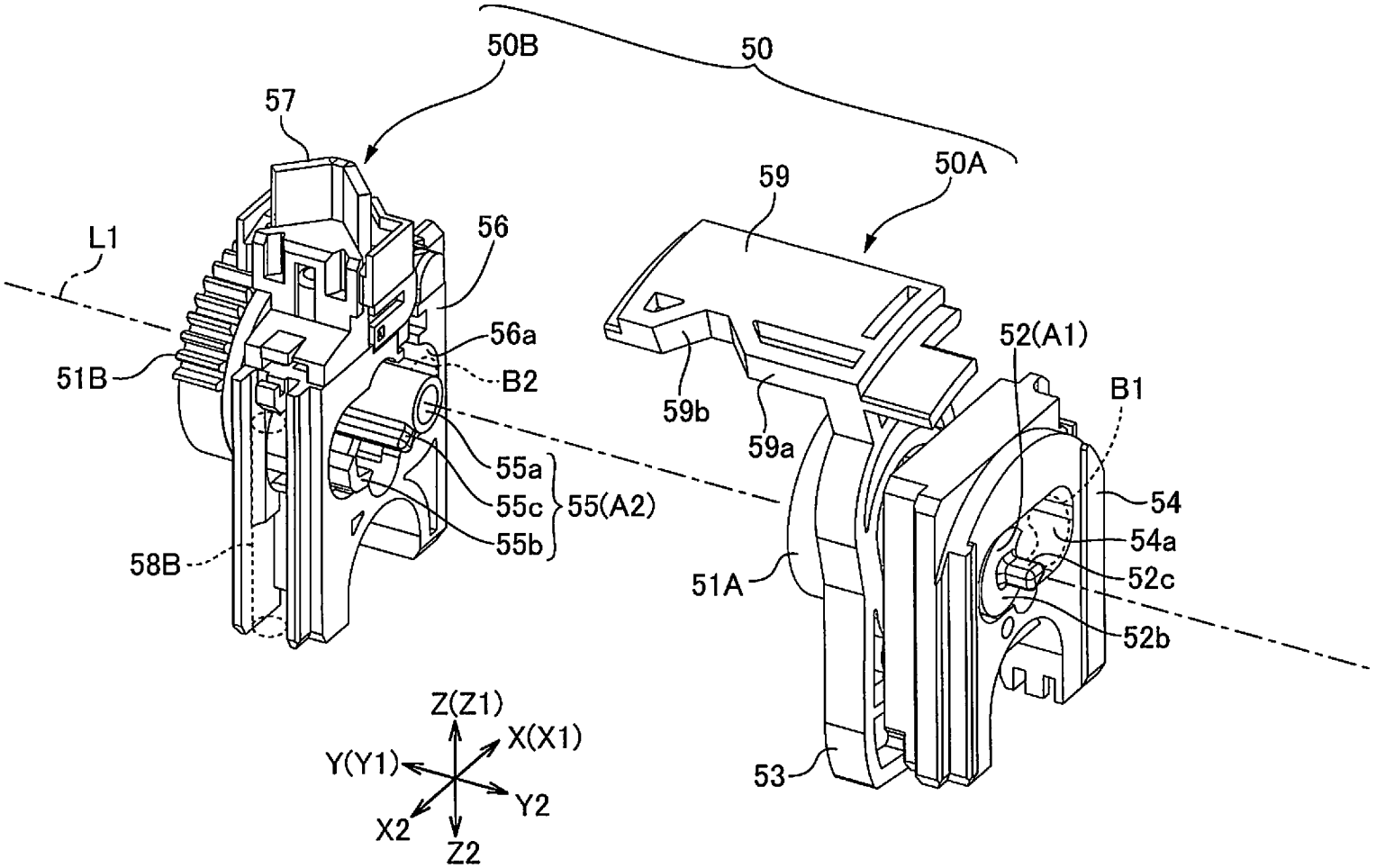
FIG. 11 is an exploded oblique view of the wiper unit separated into the wiper part and the wiper cleaner.

FIG. 9 and FIG. 10 are exploded oblique views of a wiper unit 50, FIG. 9 being a view from the back Y2 side and FIG. 10 being a view from the front Y1 side. FIG. 11 is an exploded oblique view of the wiper unit separated into the wiper part and the wiper cleaner part. As shown in FIG. 11, the wiper unit 50 includes a wiper cleaner part 50A and a wiper part 50B disposed side by side on the longitudinal axis Y.

Because there are four wiper units 50 in this embodiment of the invention, four sets of wiper cleaner parts 50A and wiper parts 50B are disposed on the longitudinal axis Y (see FIG. 7).

The wiper device 30 also has a wiper drive mechanism 30A (see FIG. 7) that drives operation of the wiper cleaner lever 53 of the wiper cleaner part 50A and operation of the wiper 57 of the wiper part 50B sequentially in each of the wiper units 50. The wiper drive mechanism 30A includes the drive shaft 61 and support shaft 62 described above, and a plurality of gear units 30B disposed along the axis of the drive shaft 61.

Each gear unit 30B includes two sets of gear units, a first gear unit 30B(1) and a second gear unit 30B(2). The first gear unit 30B(1) comprises the first drive gear 64A, and the first intermittent gear 51A and first rotary cam 52 of the wiper cleaner part 50A described below. The second gear unit 30B (2) includes the second drive gear 64B, and the second intermittent gear 51B and second rotary cam 55 of the wiper part 50B described below. The first and second gear units 30B(1), 30B(2) are disposed alternately along the drive shaft 61 and support shaft 62. The plural gear units 30B are connected to mesh sequentially through the group of gear units based on the rotation of the drive shaft 61 in one direction.

Wiper Cleaner Part

The wiper cleaner part 50A includes the first intermittent gear 51A, first rotary cam 52, wiper cleaner lever 53, first lift member 54, and first coil spring 58A (see FIG. 10). The wiper cleaner part 50A causes the wiper cleaner lever 53 to pivot at the bottom end thereof on the transverse axis X by means of the first rotary cam 52 that rotates in unison with the first intermittent gear 51A. A cleaning blade 59 is disposed to the distal end (top end) of the wiper cleaner lever 53. As shown in FIG. 4 and FIG. 5, the cleaning blades 59 are located in the openings 45 in the inside case 41 of the wiper device 30. The cleaning blade 59 functions as a cover member that opens and closes the opening 45, and as a cleaning member that removes ink and other accretions from the wiper 57.

The cleaning blade 59 curves according to the shape of the curved surface 44 of the inside case 41 in which the openings 45 are formed. When the wiper cleaner lever 53 rocks, the cleaning blade 59 moves on the transverse axis X.

The wiper cleaner lever 53 moves between a closed position 53A (see FIG. 4 to FIG. 7) where the cleaning blade 59 covers the wiper 57 in the opening 45 from the top Z1, and an open position 53B (see FIG. 4 to FIG. 7) where the cleaning blade 59 is retracted to the suction unit 20 side. FIG. 4 to FIG. 7 show the wiper cleaner lever 53 of the wiper unit 50 located at the back Y2 side end of the group of wiper units 50 in the open position 53B, and the other three wiper cleaner levers 53 in the closed position 53A. Because the cleaning blade 59 is retracted from above the wiper 57 in the open position 53B, the cleaning blade 59 does not interfere with the wiper 57 moving up and down on the vertical axis Z through the opening 45.

As shown in FIG. 9 and FIG. 10, the opposite end of the wiper cleaner lever 53 as the cleaning blade 59 (that is, the bottom end) forks into two parts. The drive shaft 61 passes through the channel 53*a* between the legs of the fork. The wiper cleaner lever 53 is thereby supported rockably on the transverse axis X by the drive shaft 61.

A through-hole 53*b* that passes through the wiper cleaner lever 53 on the longitudinal axis Y is also formed between the cleaning blade 59 and the channel 53*a*. This through-hole 53*b* is an oval that is long on the vertical axis Z.

The first lift member 54 is disposed on the back Y2 side of the wiper cleaner lever 53. The first lift member 54 has a through-hole 54*a* superimposed with the through-hole 53*b* in the wiper cleaner lever 53. This through-hole 54*a* is an oval that is long on the transverse axis X.

As shown in FIG. 9, the first rotary cam 52 includes a first cam part 52*a* that protrudes from the first intermittent gear 51A to the back Y2 side; a second cam part 52*b* that protrudes further from the distal end of the first cam part 52*a*; and a third cam part 52*c* that protrudes further from the distal end of the second cam part 52*b*.

As shown in FIG. 11, the first intermittent gear 51A and the first rotary cam 52, the wiper cleaner lever 53, and the three members of the first lift member 54 are assembled with the first cam part 52*a* in the through-hole 53*b* of the wiper cleaner lever 53, and the first cam part 52*a* in the through-hole 54*a* of the first lift member 54. The first rotary cam 52 rotates on the axis of rotation L1 of the support shaft 62 in unison with the first intermittent gear 51A rotatably attached to the support shaft 62. After being assembled, the third cam part 52*c* protrudes from the first lift member 54 to the back Y2 side. As described above, when positioned to the back Y2 side end of the group of wiper units 50, the third cam part 52*c* embodies a cam mechanism that transfers rotation to the third intermittent gear 66A, and a cam mechanism that transfers rotation to the second intermittent gear 51B of the adjacent wiper unit 50.

As shown in FIG. 10, a fourth cam part 52*d* is formed on the front Y1 side of the first intermittent gear 51A. The fourth cam part 52*d* is shaped as a protrusion projecting to the inside from the inside surface at one place on the inside circumference side of a circular recess centered on the axis of rotation (that is, the axis of rotation L1) of the first intermittent gear 51A. A sixth cam part 55*c* provided on the second rotary cam 55 of the adjacent wiper part 50B as described below is positioned to the fourth cam part 52*d*. The fourth cam part 52*d* and sixth cam part 55*c* forma cam mechanism that transfers rotation between the first intermittent gear 51A of the wiper cleaner part 50A and the second rotary cam 55 and second intermittent gear 51B of the wiper part 50B.

When the first intermittent gear 51A meshes with the first drive gear 64A, and the drive shaft 61 turns in the first direction of rotation CCW, the first rotary cam 52 of the wiper cleaner part 50A formed in unison with the first intermittent gear 51A turns in the second direction of rotation CW. The first cam part 52*a* of the first rotary cam 52 thus moves on the vertical axis Z in the through-hole 53*b* and rocks the wiper cleaner lever 53 on the transverse axis X to the one side X1 side (to the suction unit 20 side shown in FIG. 4). In other words, the wiper cleaner lever 53 moves from the closed position 53A to the open position 53B. This is the opening operation of the wiper cleaner lever 53.

When the drive shaft 61 rotates in the second direction of rotation CW, the first rotary cam 52 rotates in the first direction of rotation CCW. At this time, the first cam part 52*a* rocks the wiper cleaner lever 53 on the transverse axis X to the other side X2 side (the opposite side as the suction unit 20). As a result, the wiper cleaner lever 53 moves from the open position 53B to the closed position 53A. This is the closing operation of the wiper cleaner lever 53.

When the first rotary cam 52 turns in the second direction of rotation CW or the first direction of rotation CCW, and the first cam part 52*a* rocks the wiper cleaner lever 53, the second cam part 52*b* moves on the transverse axis X in the through-hole 54*a* of the first lift member 54 and moves the first lift member 54 on the vertical axis Z. A guide slot in which the distal end of the first lift member 54 on the transverse axis X inserts is formed in the side of the inside case 41 holding the wiper units 50. The first lift member 54 is guided up and down by this guide slot.

As shown in FIG. 10, one end of the first coil spring 58A (first urging member) is engaged with the first lift member 54. The other end of the first coil spring 58A is caught on the bottom end of the side of the inside case 41. The first lift member 54 is thus urged to the bottom Z2 by the first coil spring 58A.

The first rotary cam 52 rotates between rotational position A1 (see FIG. 11) whereat the wiper cleaner lever 53 has been moved to the closed position 53A by the first cam part 52*a*, and rotational position B1 (see FIG. 11) whereat the wiper cleaner lever 53 has been moved to the open position 53B by the first cam part 52*a*.

The first intermittent gear 51A formed in unison with the first rotary cam 52 rotates in the same phase. The portion of the first intermittent gear 51A that meshes with the first drive gear 64A while rotating from the rotational position A1 to the rotational position B1 has teeth, and the remaining portion is toothless.

The urging force of the first coil spring 58A works on the second cam part 52*b* through the first lift member 54. This urging force causes the first intermittent gear 51A to rotate to the side where it disengages the first drive gear 64A (that is, to the idle side). More specifically, at rotational position A1, this urging force causes the first rotary cam 52 to rotate to the opposite side as rotational position B1; and at rotational position B1, causes the first rotary cam 52 to rotate to the opposite side as rotational position A1.

By thus urging the first intermittent gear 51A to the idle position side, the first intermittent gear 51A and first drive gear 64A accidentally meshing and starting to move as a result of the rotational position of the first intermittent gear 51A shifting due to vibration, for example, can be avoided.

Wiper Part

The wiper part 50B includes the second intermittent gear 51B, second rotary cam 55, a second lift member 56, a wiper 57, and a second coil spring 58B. The second lift member 56 of the wiper part 50B moves up and down by the second rotary cam 55 rotating in unison with the second intermittent gear 51B, and thereby moves the wiper 57 mounted on the second lift member 56 vertically.

The wiper 57 is an elastic member made of rubber, for example, and is disposed to the top of the second lift member 56. The wiper 57 moves between a retracted position 57A (FIG. 4, FIG. 7) lowered to the bottom Z2 from the opening 45, and a wiping position 57B (FIG. 4, FIG. 7) protruding to the top Z1 side from the opening 45. When the wiper 57 is protruding to the wiping position 57B and the inkjet head 7 moves on the transverse axis X and passes over the wiper device 30, the wiper 57 slides against the nozzle face 7*a* of the inkjet head 7 (the nozzle faces of unit heads 71 and 73, or the nozzle faces of unit heads 72 and 74). When the wiper 57 is retracted to the retracted position 57A, it does not slide against the nozzle faces 7*a*.

As shown in FIG. 9, the second rotary cam 55 has a cylindrical part 55*a* extending from the center of the second intermittent gear 51B to the back Y2 side, a fifth cam part 55*b* protruding to the back Y2 side at a position closer to the outside circumference than the cylindrical part 55*a*, and a sixth cam part 55*c* extending on the longitudinal axis Y along the outside circumference of the cylindrical part 55*a*. The support shaft 62 passes through the cylindrical part 55*a*.

A through-hole 56*a* is formed passing through the second lift member 56 on the longitudinal axis Y. The through-hole 56*a* is an oval that is long on the transverse axis X. As shown in FIG. 11, the second intermittent gear 51B and second rotary cam 55, the two members of the second lift member 56, the cylindrical part 55*a*, fifth cam part 55*b*, and sixth cam part 55*c* are assembled in the through-hole 56*a* of the second lift member 56. The second rotary cam 55 rotates on the axis of rotation L1 of the support shaft 62 in unison with the second intermittent gear 51B rotatably attached to the support shaft 62. After being assembled, the cylindrical part 55*a* and sixth cam part 55*c* protrude from the second lift member 56 to the back Y2 side (to the wiper cleaner part 50A side).

As described above, the sixth cam part 55*c* is positioned to the fourth cam part 52*d* of the first intermittent gear 51A of the adjacent wiper cleaner part 50A.

As shown in FIG. 10, a seventh cam part 55*d* is formed on the front Y1 side surface of the second intermittent gear 5B. The seventh cam part 55*d* is shaped as a protrusion projecting to the inside from the inside surface at one place on the inside circumference side of a circular recess centered on the axis of rotation (that is, the axis of rotation L1) of the second intermittent gear 51B. As described above, the seventh cam part 55*d* embodies a cam mechanism that transfers rotation to the third intermittent gear 66A when positioned at the front Y1 side end of the group of wiper units 50. The seventh cam part 55*d* also embodies a cam mechanism that transfers rotation to the first intermittent gear 51A of the adjacent wiper unit 50.

When the second intermittent gear 51B of the wiper part 50B is meshed with the second drive gear 64B, and the drive shaft 61 turns in the first direction of rotation CCW, the second rotary cam 55 formed in unison with the second intermittent gear 51B turns in the second direction of rotation CW. At this time, the fifth cam part 55*b* of the second rotary cam 55 moves on the transverse axis X in the through-hole 56*a*, and moves the second lift member 56 vertically. After the wiper 57 rises from the retracted position 57A described above to the wiping position 57B, it returns to the retracted position 57A. This is the wiping operation of the wiper 57.

When the drive shaft 61 of the wiper part 50B turns in the second direction of rotation CW, the second rotary cam 55 moves the second lift member 56 vertically. The wiper 57 of the wiper part 50B thus performs the wiping operation whether the drive shaft 61 turns in the first direction of rotation CCW or the second direction of rotation CW.

A guide slot in which the distal end of the second lift member 56 on the transverse axis X inserts is formed in the side of the inside case 41 holding the wiper units 50. The second lift member 56 is guided up and down by this guide slot. As shown in FIG. 9, one end of the second coil spring 58B (second urging member) is engaged with the second lift member 56. The other end of the second coil spring 58B is caught on the bottom end of the side of the inside case 41. The second lift member 56 is thus urged to the bottom Z2 by the second coil spring 58B.

The second rotary cam 55 rotates between rotational position A2 (see FIG. 11) at which the fifth cam part 55*b* is at one end of the through-hole 56*a* on the transverse axis X, and rotational position B2 (see FIG. 11) at which the fifth cam part 55*b* is at the other end of the through-hole 56*a*. The second rotary cam 55 and the second intermittent gear 51B formed in unison therewith rotate in the same phase. The second intermittent gear 51B has teeth in the portion that meshes with the first drive gear 64A when rotating from the rotational position A2 to the rotational position B2, and is toothless in the remaining portion.

When the urging force of the second coil spring 58B works on the fifth cam part 55*b* through the second lift member 56, this urging force works to rotate the second intermittent gear 51B to the side where it is disengaged with the second drive gear 64B (that is, to the idle position side). More specifically, at rotational position A2, this urging force causes the second rotary cam 55 to rotate to the opposite side as rotational position B2; and at rotational position B2, causes the second rotary cam 55 to rotate to the opposite side as rotational position A2.

By thus urging the second intermittent gear 51B to the idle position side, the second intermittent gear 51B and second drive gear 64B accidentally meshing and starting to move as a result of the rotational position of the second intermittent gear 51B shifting due to vibration, for example, can be avoided.

Outbound Operating Sequence

Figure 12A:
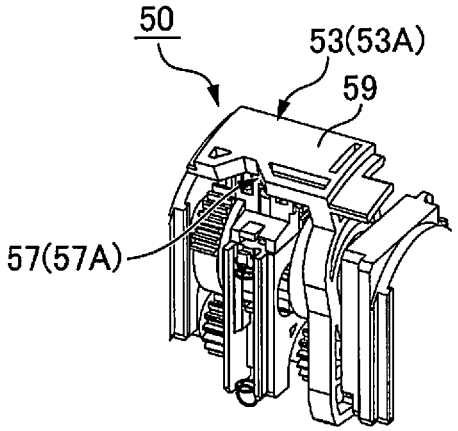
FIGS. 12A, 12B and 12C illustrate the operation of the wiper unit.
Figure 12B:
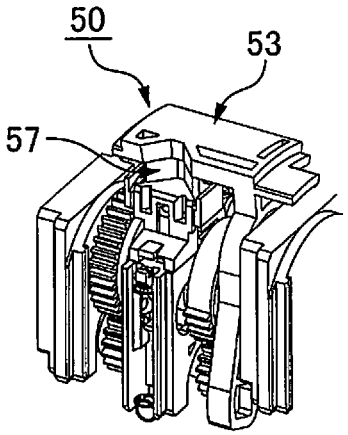
Figure 12C:
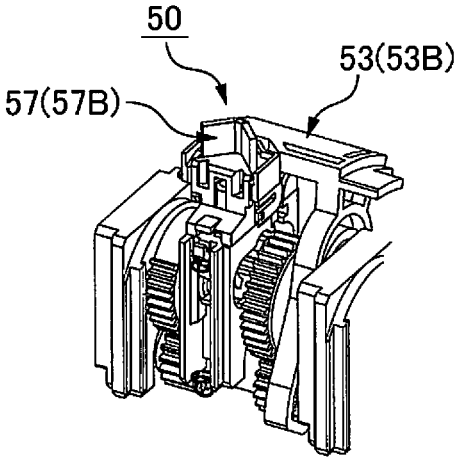

FIG. 12 illustrates the operation of the wiper unit 50. FIG. 12 (*a*) shows the wiper cleaner lever 53 in the closed position 53A, and the wiper 57 in the retracted position 57A. FIG. 12 (*b*) shows the wiper cleaner lever 53 at a position between the open position 53B and the closed position 53A, and the wiper 57 raised partially from the retracted position 57A to the wiping position 57B. FIG. 12 (*c*) shows the wiper cleaner lever 53 at the closed position 53A and the wiper 57 at the wiping position 57B.

The outbound operating sequence of the wiper unit 50 is a set of two operations: opening the wiper cleaner lever 53 (the wiper cleaner lever 53 moving one way from the closed position 53A to the open position 53B), and moving the wiper 57 vertically (moving one round trip from the retracted position 57A to the wiping position 57B, and then returning to the retracted position 57A again). This outbound operation (outbound operating sequence) is executed once sequentially by each of the four wiper units 50. In the outbound operation, the wiper units 50 operate in the sequence of FIG. 12 (*a*), FIG. 12 (*b*), and FIG. 12 (*c*), and operation continues until the wiper 57 descends to the retracted position 57A. The outbound operating sequence starts with the wiper cleaner levers 53 of all four wiper units 50 in the closed position 53A (initial position). When the outbound operating sequence ends, the wiper cleaner levers 53 of all four wiper units 50 are in the open position 53B (intermediate position).

As described above, the outbound operating sequence of the wiper unit 50 starts by the first intermittent gear 51A of the wiper cleaner part 50A starting to turn based on rotation of the adjacent intermittent gear (the third intermittent gear 66A, or the second intermittent gear 51B of the adjacent wiper part 50B).

In the following example, the first wiper unit 50 located at the back Y2 side end of the four wiper units 50 is wiper unit 50(1), and in sequence from the back Y2 side to the front Y1 side, the second wiper unit 50 is wiper unit 50(2), the third is wiper unit 50(3), and the fourth is wiper unit 50(4) as shown in FIG. 4, FIG. 5, and FIG. 7.

When the outbound operation starts, the wiper unit 50 is positioned as shown in FIG. 12 (*a*).

When the first intermittent gear 51A of the first wiper unit 50(1) in the group of wiper units 50 meshes with the first drive gear 64A and starts turning, the first rotary cam 52 turns, and the opening operation of the wiper cleaner lever 53 starts. At an intermediate rotational position in the opening operation of the wiper cleaner lever 53, the first intermittent gear 51A starts turning the second intermittent gear 51B of the wiper part 50B through the cam mechanism (fourth cam part 52*d* and sixth cam part 55*c*). As a result, the wiper 57 starts rising with a slight delay from the operation of the wiper cleaner lever 53 (see FIG. 12 (*b*)). When the first intermittent gear 51A turns a specific angle (such as 30 degrees) from when the second intermittent gear 51B starts turning, the first intermittent gear 51A disengages the first drive gear 64A and returns to the idle phase. As a result, the wiper cleaner lever 53 stops at the open position 53B. The second intermittent gear that left the idle phase and meshed continues turning, however, and the wiper 57 rises to the wiping position 57B (FIG. 12 (*c*)) and then descends. Operation to this point is the outbound operation of the first wiper unit 50(1).

The outbound operation of the second wiper unit 50(2) is executed next. At a rotational position before the wiper 57 stops traveling, the second intermittent gear 51B of the first wiper unit 50(1) starts turning the first intermittent gear 51A in the wiper cleaner part 50A of the second wiper unit 50(2) through the cam mechanism (seventh cam part 55*d* and third cam part 52*c*). As a result, the first intermittent gear 51A engages the first drive gear 64A and starts turning. As a result, the outbound operation of the second wiper unit 50(2) starts.

When the outbound operation of the second wiper unit 50(2) ends, the outbound operation of the third wiper unit 50(3) starts, and the outbound operation of the fourth wiper unit 50(4) then follows.

In the outbound operating sequence of the wiper units 50, the four sets of first intermittent gears 51A and second intermittent gears 51B thus sequentially go from the idle phase to the meshed phase and start turning based on the rotation of the drive shaft 61 at a predetermined phase difference, and then return sequentially to the idle phase, in order from the first intermittent gear 51A located first at the back Y2 side end.

Return Operating Sequence

The return operating sequence of the wiper unit 50 is also a set of two operations: raising and lowering the wiper 57, and closing the wiper cleaner lever 53 (moving one way from the open position 53B to the closed position 53A). This return operation is executed sequentially once each by the four wiper units 50. The return operation starts with the wiper cleaner lever 53 in the open position 53B and the wiper 57 in the retracted position 57A. In the return operation, the wiper unit 50 operates in the reverse order of the outbound operation, that is, in the order from FIG. 12 (*c*) to FIG. 12 (*b*) and then FIG. 12 (*a*). The return operating sequence starts with the wiper cleaner levers 53 of all four wiper units 50 in the open position 53B (intermediate position). When the return operating sequence ends, the wiper cleaner levers 53 of all four wiper units 50 are returned to the closed position 53A (initial position).

As described above, the return operation of the wiper unit 50 starts when the second intermittent gear 51B of the wiper part 50B starts turning based on rotation of the adjacent intermittent gear (fourth intermittent gear 66B, or the first intermittent gear 51A of the adjacent wiper cleaner part 50A).

When the second intermittent gear 51B of the fourth wiper unit 50(4) in the group of wiper units 50 meshes with the second drive gear 64B and starts turning, the second intermittent gear 51B and the second rotary cam 55 rotate based on rotation of the drive shaft 61, and the wiper 57 moves vertically (see FIG. 12 (*c*)). At a rotational position before the lift operation of the wiper 57 ends, the second intermittent gear 51B starts turning the first intermittent gear 51A of the adjacent wiper cleaner part 50A through the cam mechanism (fourth cam part 52*d* and sixth cam part 55*c*).

As a result, the first rotary cam 52 turns and the closing operation of the wiper cleaner lever 53 executes (FIG. 12 (*b*)). When the second intermittent gear 51B turns a specific angle (such as 30 degrees) from when the first intermittent gear 51A starts turning, the second intermittent gear 51B disengages the second drive gear 64B and returns to the idle phase, and the lift operation of the wiper part 50B ends. The first intermittent gear that has left the idle phase and meshed, however, continues turning until the wiper cleaner lever 53 returns to the closed position 53A (see FIG. 12 (*a*)), and then returns to the idle phase. Operation to this point is the return operation of the fourth wiper unit 50.

The return operation of the third wiper unit 50(3) then executes. At a rotational position before the closing operation of the wiper cleaner lever 53 ends, the first intermittent gear 51A of the fourth wiper unit 50(4) starts turning the second intermittent gear 51B in the wiper part 50B of the third wiper unit 50(3) through the cam mechanism (seventh cam part 55*d* and third cam part 52*c*). As a result, the second intermittent gear 51B meshes with the second drive gear 64B and leaves the idle phase. As a result, the return operation of the third wiper unit 50(3) starts.

The return operation of the second wiper unit 50(2) likewise starts when the return operation of the third wiper unit 50(3) ends, and is then followed by the return operation of the first wiper unit 50(1).

In the return operating sequence of the wiper units 50, the four first intermittent gear 51A and second intermittent gear 51B sets thus sequentially go from the idle phase to the meshed phase and start turning based on the rotation of the drive shaft 61 at a predetermined phase difference, and then return sequentially to the idle phase, in the opposite order as the outbound operation.

An example of an operating sequence that drives all four wiper units 50 is described above, but an operating sequence that moves only some of the four wiper units 50 is also conceivable. For example, the return operation could be executed by changing the direction of rotation of the drive shaft 61 after the outbound operation has been executed to one of the first to third wiper units 50. This enables wiping with the wiper 57 at a desired position without operating unnecessary wiper units 50.

Wiping Operation

As shown in FIG. 9 to FIG. 11, the wiper cleaner lever 53 has a cleaning part 59*a* formed on the cleaning blade 59 on the edge on the one side X1 of the transverse axis X (the opposite side as the suction unit 20). The cleaning part 59*a* is the part that is located at the front in the direction of movement when the wiper cleaner lever 53 returns from the open position 53B to the closed position 53A, and slides against the surface of the wiper 57 to which ink and other matter sticks. In the wiper device 30, the wiper 57 moves vertically (wiping operation) before the wiper cleaner lever 53 returns from the open position 53B to the closed position 53A. The control unit of the printer 1 controls the wiper device 30 and the head frame 12 so that when the wiper 57 is raised to the wiping position 57B in the wiping operation, the inkjet head 7 moves from the maintenance position 7B above the suction unit 20 to the printing position 7A above the platen unit 8. As a result, the nozzle face 7*a* is wiped and ink and other accretions are removed by the wiper 57 at the wiping position 57B.

To wipe the nozzle face of the head unit 7Bk located at the back Y2 side end of the inkjet head 7, for example, the control unit of the printer 1 executes the outbound operation of the first wiper unit 50(1), and when the wiper 57 is at the wiping position 57B during the outbound operation, moves the inkjet head 7 from the maintenance position 7B to the printing position 7A.

To wipe the nozzle face of the head unit 7C, the control unit of the printer 1 moves the inkjet head 7 from the maintenance position 7B to the printing position 7A when the wiper 57 is at the wiping position 57B during the outbound operation of the second wiper unit 50(2).

Likewise, to wipe the nozzle faces of head unit 7M and head unit 7Y, the control unit of the printer 1 moves the inkjet head 7 from the maintenance position 7B to the printing position 7A, when the wiper 57 is at the wiping position 57B during the outbound operation of the third and fourth wiper units 50M, 50Y.

As described above, the outbound operating sequence is executed when the wiper moving unit 40 carrying the wiper units 50 is at the back position 40A. As a result, the unit heads 71 and 73 of the head units are wiped when the inkjet head 7 is moved during the outbound operation.

Because the return operation is executed when the wiper moving unit 40 is at the front position 40B, the unit heads 72 and 74 of the head units are wiped when the inkjet head 7 is moved during the return operation.

By thus appropriately moving the inkjet head 7 during the outbound and return operating sequences, the two rows of heads disposed on each head unit can be selectively wiped.

Wiper Shape

The wiper 57 is made from an elastic material such as rubber, and has a basically U-shaped configuration pointing to the one side X1 of the transverse axis X (the suction unit 20 side). A recess 59*b* shaped according to the U-shape of the wiper 57 is formed in the cleaning part 59*a*. As described above, when the wiper 57 wipes the nozzle face 7*a*, the nozzle face 7*a* moves in the direction from the maintenance position 7B to the printing position 7A, and the wiper 57 therefore slides across the nozzle face 7*a* with the U-shaped surface leading. The wiper 57 is thus shaped like a U pointing to the front in the direction in which it slides against the nozzle face 7*a*. By thus wiping with the U-shaped surface leading, deformation of the wiper 57 while wiping can be suppressed. The ability of the wiper 57 to remove ink and other accretions from the nozzle face 7*a* is therefore improved.

When the wiper cleaner lever 53 closes, the cleaning part 59*a* moves in the same direction as the nozzle face 7*a*, slides against the U-shaped surface of the wiper 57, and wipes ink and other accretions from the wiper 57. Thus shaped, depression of the wiper 57 can be suppressed when cleaning by sliding the cleaning part 59*a* against the wiper 57.

The cleaning part 59*a* is also shaped concavely according to the convex U-shaped configuration of the wiper 57. The cleaning part 59*a* can therefore press firmly against and wipe the surface of the wiper 57. The ability to remove ink and other accretions from the wiper 57 is therefore improved.

Processing Wiped Ink

A slide part 45*a* (FIG. 4 to FIG. 6) that slides against the cleaning part 59*a* is formed in the inside case 41 on the inside of the opening 45 at a position vertically overlapping (on the vertical axis Z) the cleaning part 59*a* of the cleaning blade 59 at the closed position 53A. The slide part 45*a* is located in front (the other side X2 on the transverse axis X) of the wiper 57 in the direction in which the cleaning part 59*a* moves when cleaning. Ink and other accretions transferred from the wiper 57 to the cleaning part 59*a* of the cleaning blade 59 are removed from the cleaning blade 59 by the cleaning part 59*a* sliding last against the slide part 45*a* in the closing operation of the wiper cleaner lever 53. The ink and other accretions that are removed drop from the slide part 45*a* onto some other part inside the inside case 41, or flow down along the side of the inside case 41, for example. The excreted ink and other accretions are then absorbed and held by an ink sponge 80 (see FIG. 6 (*a*)) disposed in the bottom of the outside case 31.

A through-hole 41*c* is formed in the side 41*b* of the inside case 41 near the slide part 45*a*. A porous sheet 81 (flow path) is disposed through the through-hole 41*c* from the slide part 45*a* past the outside of the case side 41*b* to the case bottom.

The porous sheet 81 is disposed in the space between the bottom case 32 and the inside case 41 when the inside case 41 is placed in the bottom case 32 of the outside case 31. The bottom end of the porous sheet 81 extends to a position reaching the ink sponge 80. This porous sheet 81 forms an ink path from the slide part 45*a* to the bottom of the outside case 31. By providing such an ink path, ink removed by the wiper 57 can be absorbed by the porous sheet 81 and travel to the ink sponge 80 in the case bottom. Ink dripping directly onto other parts can therefore be suppressed, and the waste ink can be efficiently collected in the ink sponge 80.

Main Effect of the Invention

The printer 1 and wiper device 30 according to the foregoing embodiment have plural wiper units 50 each including a wiper 57 and a wiper cleaner lever 53, and sequentially operate both the wipers 57 and the wiper cleaner levers 53 by driving a single wiper motor 46 in one direction. A common actuator can thus be used for the wipers 57 and the wiper cleaner levers 53.

The wiper cleaner levers 53 are rockers, and the direction in which the cleaning blades 59 disposed to the distal ends of the wiper cleaner levers 53 move (that is, the direction in which the wiper cleaner levers 53 rock on the transverse axis X) intersects the direction in which the wipers 57 move (on the vertical axis Z). The ability to remove ink and other accretions from the wipers 57 is therefore greater than when simply sliding the wiper cleaner lever 53 along the surface of the wiper 57. Device size can therefore be effectively reduced and performance removing ink and other accretions is excellent.

This embodiment has a plurality of wiper units 50 arranged in a line, and drives the wiper units 50 sequentially down the line based on rotation of the wiper motor 46 in one direction. More specifically, turning the drive shaft 61 in the first direction of rotation CCW by means of the wiper motor 46 drives an outbound sequence operation driving the four wiper units 50 sequentially from the back Y2 side to the front Y1 side. Turning the drive shaft 61 in the second direction of rotation CW by means of the wiper motor 46 drives a return sequence operation driving the four wiper units 50 sequentially from the front Y1 side to the back Y2 side.

The nozzle faces 7*a* can also be selectively wiped by moving the inkjet head 7 to pass over the wiper device 30 timed to driving the wiper units 50 that are positioned in the areas of the nozzle faces 7*a* to be wiped. As a result, the wiper unit can be constructed to selectively wipe the nozzle faces without needing to provide multiple drive sources. Furthermore, the wiper units can be driven by a single wiper motor 46 even if the number of wiper units increases, and there is no need to increase the number of actuators. The plural wiper units 50 can also be driven in a predetermined sequence, and the operating pattern is simple. Construction can therefore be simplified, and operating speed increased. The invention is therefore useful for making the wiper device 30 small, simple, and fast. The invention is also useful for selectively wiping the nozzle faces 7*a* of a large inkjet head 7 such as a line inkjet head.

In this embodiment, the wiping operation of the wiper 57 and the opening and closing operations of the wiper cleaner lever 53 are also linked based on rotation of the drive shaft 61 in one direction. The wiper cleaner levers 53 contact the wipers 57 in the opening operation or closing operation, can remove ink and other accretions from the wipers 57 in a cleaning operation, and also function as a cover member that covers the wipers 57 in the closed position 53A. The wiping operation, cleaning operation, and opening/closing operation of the openings 45 can therefore be driven by a single drive source, thereby enabling a smaller and simpler construction.

More specifically, the wiping operation of the wiper 57 and the opening and closing operations of the wiper cleaner lever 53 are linked based on rotation of the drive shaft 61 in one direction by a gear unit 30B including a drive gear, intermittent gear, and rotary cam assembly. Sequential operation of the plural wiper units 50 by a single wiper motor 46 can therefore be achieved using a compact construction including plural gear units 30B disposed along a drive shaft 61 and support shaft 62. This construction also enables operating the wiper units 50 sequentially at high speed. In other words, high speed operation can be achieved with a construction that can also selectively operate plural wiper units 50 using a single actuator.

The cleaning part 59*a* of the wiper cleaner lever 53 in this embodiment contacts the slide part 45*a* at the end of the cleaning operation and ink and other accretions are removed. Ink and other accretions on the cleaning part 59*a* of the wiper cleaner lever 53 can therefore be removed from the cleaning part 59*a* by the slide part 45*a*. The cleaning ability of the wiper cleaner levers 53 can therefore be maintained, and the ability of the wipers 57 to remove ink and other accretions from the nozzle faces 7*a* can be maintained as a result. Furthermore, because an ink path from the openings 45 to the bottom of the outside case 31 is formed by a porous sheet 81, ink removed by the wipers 57 dripping onto other parts can be suppressed, and the ink can permeate through the porous sheet 81 to the ink sponge 80 in the bottom of the case.

Other Examples

In the wiper units 50 in the foregoing embodiment, the wiper cleaner lever 53 moves through the same path in the opening operation and the closing operation. As a result, the distal end of the wiper 57 slides across the back side of the cleaning blade 59 when the wiper cleaner lever 53 moves in the opening operation as well as the closing operation. The wiper 57 therefore bends in the direction the cleaning blade 59 travels on the opening stroke, and the cleaning blade 59 snaps back elastically when separating from the wiper 57. In a construction in which the wiper 57 is thus pulled by the cleaning blade 59 on the opening stroke, ink and other accretions on the wiper 57 will be thrown off the wiper 57. Therefore, when the ink and other accretions cannot be completely removed by the cleaning operation during the closing operation, the accretions may be thrown from the wiper 57 and land elsewhere inside the device.

The embodiment described below raises the cleaning blade 59 and avoids contact with the wiper 57 in the opening operation of the wiper cleaner lever 53, and follows the same path described in the embodiment above in the closing operation to clean the wiper 57.

Figure 13A:
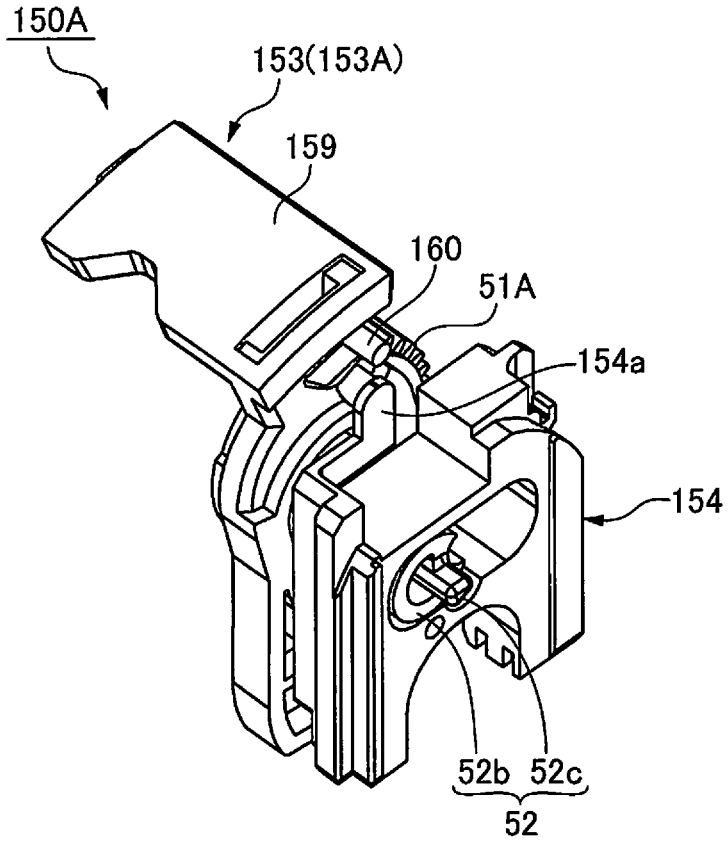
FIGS. 13A and 13B are oblique views of a modified wiper cleaner unit.
Figure 13B:
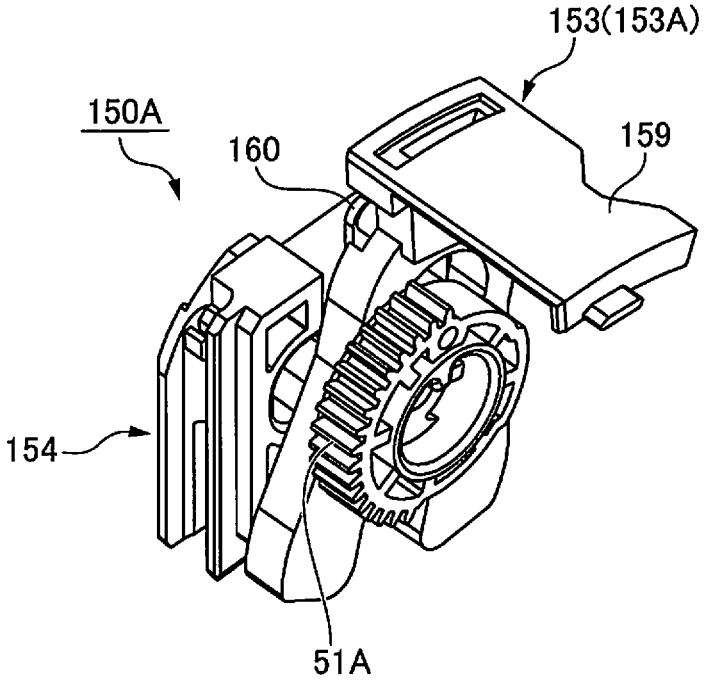
Figure 14:
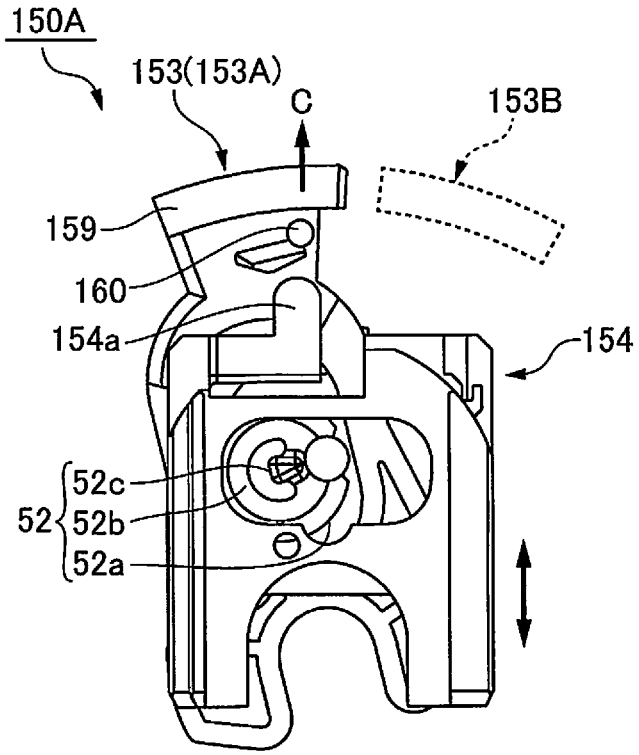
FIG. 14 is a side view of the modified wiper cleaner unit.

FIG. 13 is an oblique view of the wiper cleaner part according to another embodiment of the invention, FIG. 13 (*a*) being a view from the back Y2 side, and FIG. 13 (*b*) being a view from the front Y1 side. FIG. 14 is a side view of the wiper cleaner part in this embodiment. Only the parts that differ from the foregoing embodiment are described below, and description of the like parts is omitted.

As shown in FIG. 13 and FIG. 14, the wiper cleaner part 150A in this example has a wiper cleaner lever wiper cleaner lever 153 and a first lift member 154 (moving member) that differ from the embodiment described above.

This modified first lift member 154 moves up and down by rotation of the second cam part 52*b* disposed to the first rotary cam 52 as in the above embodiment. The configuration of the wiper part 50B in this embodiment is the same as described above, and the direction in which the first lift member 154 travels vertically is the same as the direction in which the wiper 57 of the wiper part 50B moves.

A protrusion 154*a* is formed protruding to the top Z1 from the top end of the first lift member 154. As shown in FIG. 14, this protrusion 154*a* overlaps the closed position 153A of the wiper cleaner lever 153 on the vertical axis Z. A cleaning blade 159 and a pressure part 160 located on the bottom Z2 side of the cleaning blade 159 are disposed to the wiper cleaner lever 153 in this embodiment. The pressure part 160 is located on the top Z1 side of the protrusion 154*a*.

The wiper cleaner lever 153 according to this embodiment moves between a closed position 153A and open position 153B by rotation of the first cam part 52*a* disposed to the first rotary cam 52 as described in the above embodiment. When the wiper cleaner lever 153 moves in the opening operation in this embodiment, the first lift member 154 rises by rotation of the second cam part 52*b* when the pressure part 160 passes over the protrusion 154*a*. The protrusion 154*a* therefore pushes the wiper cleaner lever 153 to the top Z1 side through the pressure part 160 during the opening operation. The cleaning blade 159 therefore moves to the open position 153B through the path rising to the top Z1 side (indicated by arrow C). The cleaning blade 159 therefore passes above the wiper 57 and moves to the open position 153B side (indicated by arrow D in FIG. 14) without touching the wiper 57.

Note that because the bottom end of the wiper cleaner lever 153 forks and straddles the drive shaft 61, the entire wiper cleaner lever 153 can move on the vertical axis Z.

When the pressure part 160 of the wiper cleaner lever 153 passes over the protrusion 154*a* of the first lift member 154, the wiper cleaner lever 153 descends. When the wiper cleaner lever 153 descends, the cleaning blade 159 passes above the wiper 57. In other words, in the opening operation moving from the closed position 153A to the open position 153B, the wiper cleaner lever 153 is moved through a path not touching the wiper 57 by means of the first lift member 154, which is moved vertically by the second cam part 52*b*. The wiper 57 will therefore not be pulled by the cleaning blade 159 during the opening operation, and ink and other accretions will not be scattered.

The pressure part 160 is located below the end of the cleaning blade 159 on the open position 153B side. In the closing operation in which the wiper cleaner lever 153 returns from the open position 153B to the closed position 153A, the protrusion 154*a* therefore rises and the pressure part 160 passes over the protrusion 154*a* at different times. As a result, in the closing operation, the wiper cleaner lever 153 is not pushed up by the protrusion 154*a* and passes the same path described in the previous embodiment. The cleaning part 159*a* of the cleaning blade 159 therefore wipes the wiper 57 in the closing operation, and can remove ink and other accretions from the wiper 57.

The wiper cleaner lever 153 in this embodiment is thus rocked by the first rotary cam 52 in the opening and closing operations, but moves through a path not contacting the wiper 57 in the opening operation, and in the closing operation travels through a path contacting the wiper 57 and cleans the wiper 57. The wiper cleaner lever 153 can therefore be prevented from contacting the wiper 57 in the opening operation, and problems such as the wiper 57 being pulled and ink and other accretions flung therefrom before wiping the nozzle face can be prevented. The first lift member 154 also functions as a member that urges the first intermittent gear 51A to the idle position side. The parts count can therefore be reduced and device size reduced.

An extension that overlaps the edge of the opening 45 is provided on a longitudinal axis Y end of the cleaning blade 59, and this extension is constructed to be inserted and slide on the bottom Z2 side of the edge of the opening 45. The cleaning blade 159 according to this embodiment, however, does not have an extension that is inserted to the bottom Z2 side of the edge of the opening 45. When the cleaning blade 159 is pushed up by the protrusion 154*a* of the first lift member 154 in the opening operation, the edge of the opening 45 therefore does not interfere with the cleaning blade 159 rising to the top Z1 side.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A wiper device comprising:

a drive shaft that turns based on rotation of a motor; and a plurality of wiper units disposed in a line along the drive shaft to wipe based on rotation of the drive shaft in one direction, each wiper unit having a wiper configured to perform a wiping operation moving between a retracted position where the wiper does not contact the nozzle face of a fluid ejection head, and a wiping position where the wiper can wipe the nozzle face of the fluid ejection head, and a wiper cleaner configured to perform a cleaning operation sliding against the wiper in a direction crosswise to the direction of wiper movement;

wherein the wiper unit has a first rotary cam that rotates according to rotation of the drive shaft and drives the wiper cleaner in the cleaning operation, and wherein the first rotary cam moves the wiper cleaner in an opening operation from a closed position covering the top of the wiper at the retracted position to an open position not contacting the wiper in the wiping position, and a closing operation returning from the open position to the closed position.

2. The wiper device described in claim 1, wherein:

the wiper cleaner configured to move in the opening operation through a path not contacting the wiper, and move in the closing operation through a path contacting the wiper in the cleaning operation.

3. The wiper device described in claim 2, wherein:

the wiper unit has a moving member configured to move in the direction of wiper movement;

the first rotary cam has a first cam part that moves the wiper cleaner between the closed position and the open position, and a second cam part that pushes the wiper cleaner by the moving member and moves the wiper cleaner on a path not contacting the wiper when moving from the closed position to the open position; and the wiper cleaner is not pushed by the moving member and moves on a path contacting the wiper when moving from the open position to the closed position.

4. The wiper device described in claim 2, further comprising:

a first drive gear and a second drive gear that rotate in unison with the drive shaft; and a first intermittent gear that meshes with the first drive gear, and a second intermittent gear that meshes with the second drive gear;

wherein the first rotary cam is formed in unison with the first intermittent gear, and the second rotary cam configured to drive the wiper in the wiping operation is formed in unison with the second intermittent gear.

5. The wiper device described in claim 1, wherein:

the wiper moves vertically toward the fluid ejection head in the wiping operation; and the wiper cleaner is supported pivotably on an axis crosswise to the vertical direction of wiper movement.

6. The wiper device described in claim 1, wherein:

the wiper cleaner has a cleaning part configured to slide against the wiper;

a slide part is positioned in front of the direction of movement of the cleaning part; and the cleaning part slides against the slide part after sliding against the wiper in the cleaning operation.

7. The wiper device described in claim 6, further comprising:

an ink sponge to hold ink wiped by the wiper; and a fluid path member forming an ink path from the slide part to the ink sponge.

8. The wiper device described in claim 1, wherein:

the wiper is convexly shaped toward the front in the direction the wiper slides against the wiper cleaner; and the wiper cleaner is concavely shaped in the part opposite the convex shape of the wiper.

9. A fluid ejection device comprising:

a fluid ejection head; and the wiper device described in claim 1;

plural wiper units are disposed to the wiper device at positions enabling wiping some nozzle faces of the fluid ejection head.

* * * * *